US009680268B1

(12) United States Patent
Finona

(10) Patent No.: US 9,680,268 B1
(45) Date of Patent: Jun. 13, 2017

(54) GENDERLESS ELECTRICAL CONNECTORS

(71) Applicant: ITT Manufacturing Enterprises LLC, Wilmington, DE (US)

(72) Inventor: Michael Finona, Lake Forest, CA (US)

(73) Assignee: ITT MANUFACTURING ENTERPRISES LLC, Wilmington, DE (US)

( * ) Notice: Subject to any disclaimer, the term of this patent is extended or adjusted under 35 U.S.C. 154(b) by 0 days.

(21) Appl. No.: 15/158,303

(22) Filed: May 18, 2016

(51) Int. Cl.

| | |
|---|---|
| ***H01R 13/28*** | (2006.01) |
| ***H01R 24/84*** | (2011.01) |
| ***H01R 24/38*** | (2011.01) |
| *H01R 107/00* | (2006.01) |

(52) U.S. Cl.
CPC ..... *H01R 24/84* (2013.01); *H01R 24/38* (2013.01); *H01R 2107/00* (2013.01)

(58) Field of Classification Search
CPC .... H01R 13/28; H01R 23/27; H01R 13/6215; H01R 13/24; H01R 23/722
USPC ..... 439/284, 291, 294, 701
See application file for complete search history.

(56) References Cited

U.S. PATENT DOCUMENTS 2,384,267 A * 9/1945 Andersen ..... H01R 13/28 439/284
2,987,691 A * 6/1961 Ross ..... H01R 13/625 285/33
3,086,188 A * 4/1963 Ross ..... H01R 13/28 439/291
3,129,993 A * 4/1964 Ross ..... H01R 13/64 285/360
3,271,726 A * 9/1966 Pfendler ..... H01R 23/27 29/830
3,275,737 A 9/1966 Caller
3,551,882 A 12/1970 O'Keefe
(Continued)

FOREIGN PATENT DOCUMENTS

DE 964 291 5/1957
EP 2 234 215 9/2010
(Continued)

OTHER PUBLICATIONS

Glenair, "The Band-It® Clamping System EMI Shield Termination Instructions," 2010, p. H-53.
Glenair, "Rectangular Connector Backshells," 2011, pp. 284.

*Primary Examiner* — Abdullah Riyami
*Assistant Examiner* — Vladimir Imas
(74) *Attorney, Agent, or Firm* — Knobbe, Martens, Olson & Bear LLP

(57) ABSTRACT

Various components and methods related to electrical connectors are disclosed. The electrical connectors can be configured to receive a plurality of cables. The electrical connectors can be configured to accommodate a plurality of cables so as to provide a high density packaging within each of the pair of electrical connectors. In order to provide appropriate shielding against electric flux and to reduce noise, each of the plurality of cables can be retained within a genderless insert that can be inserted through each of the pair of electrical connectors. Each of the genderless inserts can include an engagement end that allows the interconnection of the cables retained within the pair of electrical connectors. In some examples, the engagement end of each of the genderless inserts includes both a male and female component.

23 Claims, 17 Drawing Sheets

(56) References Cited

U.S. PATENT DOCUMENTS 3,855,566 A * 12/1974 Richardson ..... H01R 13/28 439/294
3,936,132 A 2/1976 Hutter
3,944,317 A 3/1976 Oberdiear
4,093,332 A * 6/1978 Simko ..... H01R 23/27 439/293
4,140,367 A 2/1979 Makuch et al.
4,229,064 A 10/1980 Vetter et al.
4,307,926 A 12/1981 Smith
4,364,626 A * 12/1982 Price ..... H01R 13/28 439/101
4,398,783 A 8/1983 Kelly
4,405,187 A 9/1983 Muller et al.
4,464,540 A 8/1984 Reeder
4,531,805 A 7/1985 Werth
4,583,809 A 4/1986 Werth et al.
4,614,398 A 9/1986 Wright et al.
4,630,876 A * 12/1986 Grunberg ..... H01R 23/27 439/291
4,634,208 A 1/1987 Hall et al.
4,693,323 A 9/1987 Owensby
4,799,902 A 1/1989 Laudig et al.
4,808,128 A 2/1989 Werth
4,813,887 A 3/1989 Capp
4,836,791 A 6/1989 Grabbe et al.
4,858,310 A 8/1989 Sanders
4,897,050 A 1/1990 Randolph
4,950,170 A 8/1990 Miller, Jr.
4,990,099 A * 2/1991 Marin ..... H01R 13/642 439/171
4,997,376 A 3/1991 Buck et al.
5,046,967 A 9/1991 Majernik et al.
5,052,947 A 10/1991 Brodie et al.
5,057,028 A 10/1991 Lemke et al.
5,083,943 A 1/1992 Tarrant
5,102,351 A 4/1992 Meshel
5,125,848 A * 6/1992 Zimmerly ..... H01R 13/5213 439/287
5,169,324 A 12/1992 Lemke et al.
5,429,528 A 7/1995 Longueville et al.
5,499,934 A 3/1996 Jacobsen et al.
5,547,395 A 8/1996 Delamotte
5,577,936 A 11/1996 Hahn
5,611,711 A 3/1997 Okada et al.
5,637,010 A 6/1997 Jost et al.
5,658,159 A * 8/1997 Gardner ..... B61G 5/10 213/76
5,879,191 A 3/1999 Burris
5,888,097 A 3/1999 DiCicco
5,890,922 A * 4/1999 Buchter ..... H01R 13/504 439/284
5,913,690 A 6/1999 Dechelette et al.
5,997,350 A 12/1999 Burris et al.
6,048,227 A 4/2000 Rupp et al.
6,144,561 A 11/2000 Cannella, Jr. et al.
6,203,329 B1 3/2001 Johnson et al.
6,250,963 B1 6/2001 Wright
6,447,319 B1 * 9/2002 Bodin ..... H01R 23/27 439/294
6,705,894 B1 3/2004 Comerci et al.
6,712,648 B2 3/2004 Padro et al.
6,733,336 B1 5/2004 Montena et al.
6,796,812 B2 9/2004 Reicharz
6,809,265 B1 10/2004 Gladd et al.
6,811,441 B2 11/2004 Simpson
6,817,896 B2 11/2004 Derenthal
6,857,902 B2 2/2005 Mehnert et al.
6,896,541 B2 5/2005 Benson
6,945,795 B1 9/2005 Gross III et al.
6,997,730 B2 * 2/2006 Baker ..... H01R 23/27 439/284
7,101,223 B2 9/2006 Neumann et al.
7,154,042 B2 12/2006 Auray et al.
7,195,518 B2 * 3/2007 Bert ..... H01R 4/2441 439/290
7,316,584 B2 * 1/2008 Mackillop ..... H01R 13/6477 439/607.05
7,335,063 B2 2/2008 Cohen et al.
7,404,739 B2 * 7/2008 Sheilds ..... H01R 4/2441 439/290
7,419,398 B2 * 9/2008 Goodman ..... H01R 23/27 439/284
7,637,785 B2 12/2009 Irish et al.
7,744,383 B2 6/2010 Da Silva
7,744,385 B2 6/2010 Scherer
7,753,731 B2 7/2010 Cohen et al.
7,901,239 B2 3/2011 Weber
7,977,583 B2 7/2011 Yaghmai et al.
8,123,536 B1 2/2012 Finona et al.
8,202,122 B2 6/2012 Wu
8,591,268 B2 * 11/2013 Reimchen ..... H01R 9/03 439/689
8,771,012 B2 * 7/2014 Le Tortorec ..... H01R 13/2421 439/584
8,845,351 B2 * 9/2014 Johnson ..... H01R 13/405 439/284
8,951,056 B2 * 2/2015 Pichot ..... H01R 13/523 439/294
8,961,241 B2 2/2015 Finona et al.
8,974,241 B2 * 3/2015 Finona ..... H01R 13/5208 439/271
9,004,953 B2 4/2015 Finona et al.
9,236,688 B2 * 1/2016 Friedhof ..... H01R 13/6461
9,419,384 B1 8/2016 Nguyen
2001/0002343 A1 5/2001 Suzuki
2002/0119699 A1 8/2002 Leve
2002/0177332 A1 11/2002 Hubbard et al.
2004/0224567 A1 11/2004 Zhong et al.
2005/0003713 A1 1/2005 Lappohn
2008/0020649 A1 * 1/2008 Scherer ..... H01R 13/28 439/639
2012/0034809 A1 * 2/2012 Reimchen ..... H01R 9/03 439/362
2012/0276778 A1 11/2012 Figie
2014/0302724 A1 * 10/2014 Ono ..... H01R 13/4364 439/751

FOREIGN PATENT DOCUMENTS

| | | |
|---|---|---|
| FR | 1 448 436 | 6/1966 |
| GB | 1 016 868 | 1/1966 |
| JP | 07-014645 | 1/1995 |
| WO | WO 2008/123652 | 10/2008 |

* cited by examiner

SECTION W-W

GENDERLESS ELECTRICAL CONNECTORS

BACKGROUND

Field

This disclosure relates to connectors, such as electrical connectors for transmitting power or data electronically.

Certain Related Art

Many methods exist for transmitting data electronically from one location to another. When data is transmitted over wires, electrical connectors are required for enabling data transmission between transmission lines and/or electrical circuits. Most conventional electrical connectors include a male or plug component designed to mate with a female or receptacle component.

SUMMARY OF CERTAIN FEATURES

Electrical connectors can be used for transmitting power or data electronically. In some examples, the electrical connectors can provide a radio frequency (RF) or high speed interconnection. To reduce noise and electric flux, the cables of an electrical connector can include a shielding layer. The shielding layer can increase the size of individual transmission lines and/or limit the number of cables that can be included on each electrical connector. Some electrical connectors generally have male and female mating pairs. The mating pairs can increase manufacturing costs, as an electrical connector with a female or receptacle component and an electrical connector with a male or plug component must be separately manufactured. Furthermore, the structural features of the separate male and female components may require precise engagement between the complementary portions of the electrical connectors to provide the electrical connection.

To reduce or avoid one or more of the aforementioned concerns, or other concerns, disclosed are a pair of genderless electrical connectors, such as a first connector portion and a second connector portion. The first and second connector portions can be configured to engage together to form a genderless electrical connector. In some embodiments, the first and second connector portions each include a number of genderless inserts. In certain variants, similar or identical genderless inserts are included in both of the mating connectors. In some implementations, one end of both of the electrical connectors can have the same genderless engagement end. The genderless inserts can include a first end that includes both a male and female component. The genderless inserts can include a second end that is configured to engage with (e.g., retain) an end of one of the cables.

In some embodiments, the first and second connector portions can include a plurality of openings that are configured to accommodate a plurality of cables. In some examples, each of the plurality of cables can include a shielding layer to provide a high density packaging of cables.

Each of the plurality of cables on one of the first and second connector portions can be retained within a genderless insert that is configured to engage with the genderless insert on the other complementary electrical connector. In some embodiments, the genderless inserts for the plurality of cables are arranged on each of the first and second connector portions such that the first and second connector portions are configured to engage in multiple orientations. For example, first and second connector portions can engage together in a first position and in a second position. The second position can be a position in which one of the portions is rotated relative to the other of the portions, such as being rotated at least about: 45°, 90°, 135°, 180°, 270°, or otherwise.

BRIEF DESCRIPTION OF THE FIGURES

Various embodiments are depicted in the accompanying drawings for illustrative purposes, and should not be interpreted as limiting the scope of the embodiments. Furthermore, various features of different disclosed embodiments can be combined to form additional embodiments, which are part of this disclosure.

DETAILED DESCRIPTION OF CERTAIN EMBODIMENTS

Figure 1B:
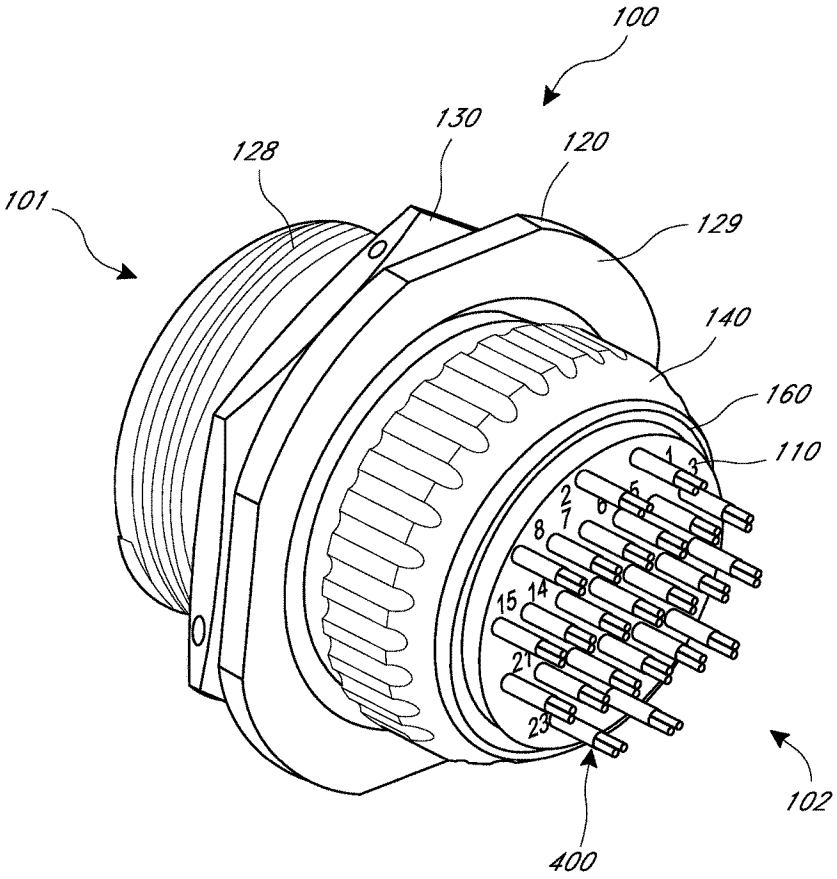
FIGS. 1A and 1B illustrate perspective views of an embodiment of a first connector portion of a genderless electrical connector.

Various electrical connectors, assemblies, and individual components are disclosed to illustrate various examples that may be employed to achieve one or more desired improvements. For purposes of presentation, certain embodiments are disclosed with respect to a RF/high-speed interconnects, but the disclosed invention can be used in other contexts as well. Indeed, the described embodiments are examples only and are not intended to restrict the general disclosure presented and the various aspects and features of this disclosure. The general principles described herein may be applied to embodiments and applications other than those discussed herein without departing from the spirit and scope of the disclosure. This disclosure should be accorded the widest scope consistent with the principles and features that are disclosed or suggested herein.

Although certain aspects, advantages, and features are described herein, it is not necessary that any particular embodiment include or achieve any or all of those aspects, advantages, and features. For example, some embodiments may not achieve the advantages described herein, but may achieve other advantages instead. No feature, component, or step is necessary or critical.

Overview

In some embodiments, a genderless electrical connector 300 can be formed from a pair of electrical connectors, such as from a first connector portion 100 and a second connector portion 200. The portions 100, 200 can be configured to receive one or a plurality of cables. The genderless electrical connector 300 can be used in a number of applications, such as the transmission of RF signals, providing a high-speed connection, or for transmitting power or other signals. As discussed above, the cables can include shielding, which can reduce noise and/or electric flux. As will be discussed in more detail below, the portions 100, 200 can be configured to accommodate a plurality of cables so as to provide high density packaging within each of the pair of electrical connectors. This can provide for increased space efficiency as well as decreased manufacturing costs (e.g., due to increased volume of usage).

In some examples, the portions 100, 200 comprise shells that secure the plurality of cables. In some embodiments, in order to provide appropriate shielding against electric flux and to reduce noise, each of the plurality of cables can be retained within a genderless insert that can be inserted through each of the pair of electrical connectors.

In some embodiments, each of the genderless inserts can include an engagement end that allows the interconnection of the cables retained within each of the genderless inserts. In some examples, the engagement end of each of the genderless inserts can include both a male and female component. The male and female component of the engagement end can remove the need for differing gendered electrical connectors. As discussed above, this can reduce manufacturing costs as an electrical connection can be formed between two cables without the need for separate and unique male and female electrical connectors. As will be discussed in more details below, in some embodiments, the electrical connectors can retain the plurality of genderless inserts such that the engagement portions of the genderless inserts protrude from a first end of each of the pair of electrical connectors, while the cable end of the genderless inserts protrude from a second end of each of the pair of electrical connectors.

In some examples, the portions 100, 200 can be connected in multiple relative orientations. As will be discussed below, in some embodiments, the engagement portions of the genderless inserts are arranged such that the portions 100, 200 can be interconnected at a first position and at a second position. For example, in some variants, one of the portions 100, 200 can be disconnected from the other of the portions 100, 200, rotated about 180 degrees, and then reconnected. In some embodiments, the portions 100, 200 can be disconnected, one of the portions 100, 200 can be flipped relative to the other of the portions 100, 200, and then the portions 100, 200 can be reconnected. In certain variants, the flipped one of the portions 100, 200 is rotated about an axis that is generally parallel with a longitudinal axis of at least one of the portions 100, 200.

FIGS. 1A-1K, 2A-2D, 3A-3B, and 4A-4E illustrate an embodiment of the pair of genderless electrical connectors. FIGS. 5A-5G illustrate an embodiment of the genderless inserts that retains each of the plurality of cables and are configured to be inserted into and retained by each mating portion of the pair of genderless electrical connectors.

Certain Embodiments of a Pair of Genderless Electrical Connectors

Figures 2A, 2B:
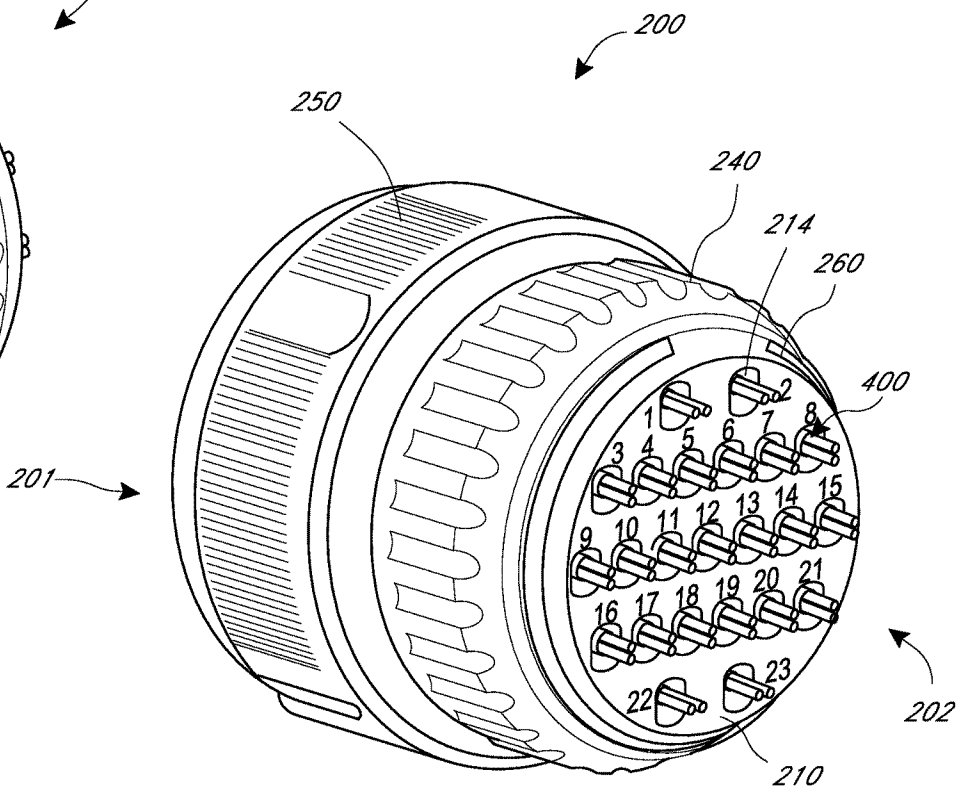
FIGS. 2A and 2B illustrate perspective views of an embodiment of a second connector portion of the genderless electrical connector.
Figure 2D:
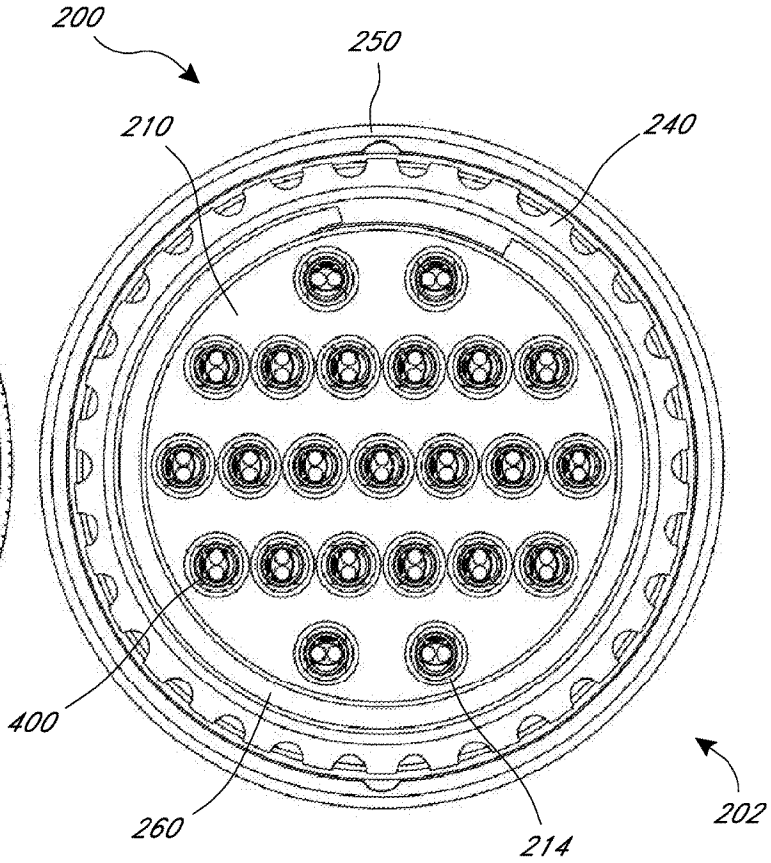
FIG. 2D illustrates a frontal view of the cable end of the second connector portion of FIGS. 2A and 2B.
Figure 2C:
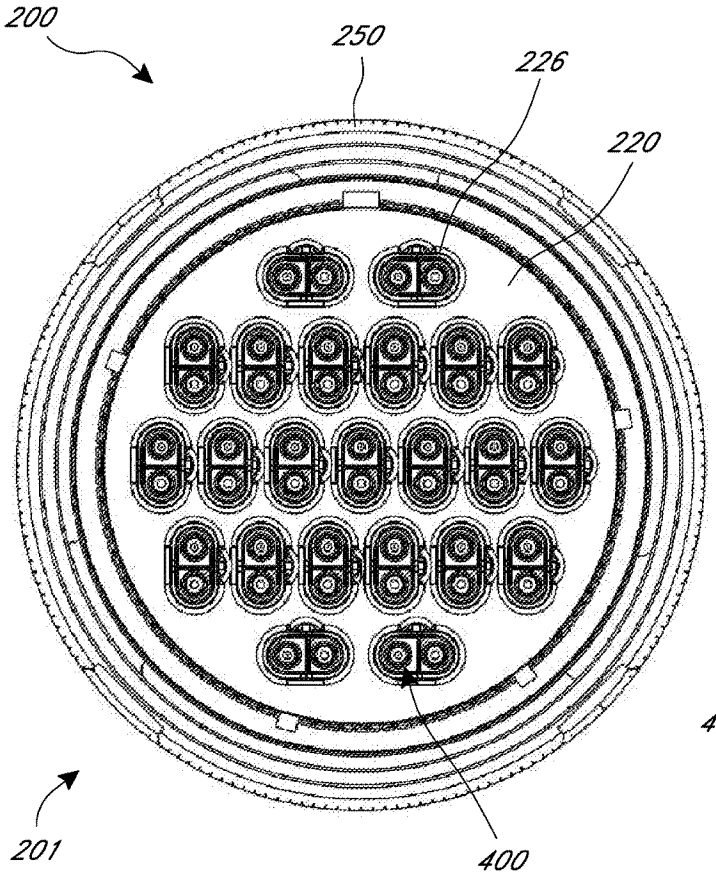
FIG. 2C illustrates a frontal view of the engagement end of the second connector portion of FIGS. 2A and 2B.
Figure 3A:
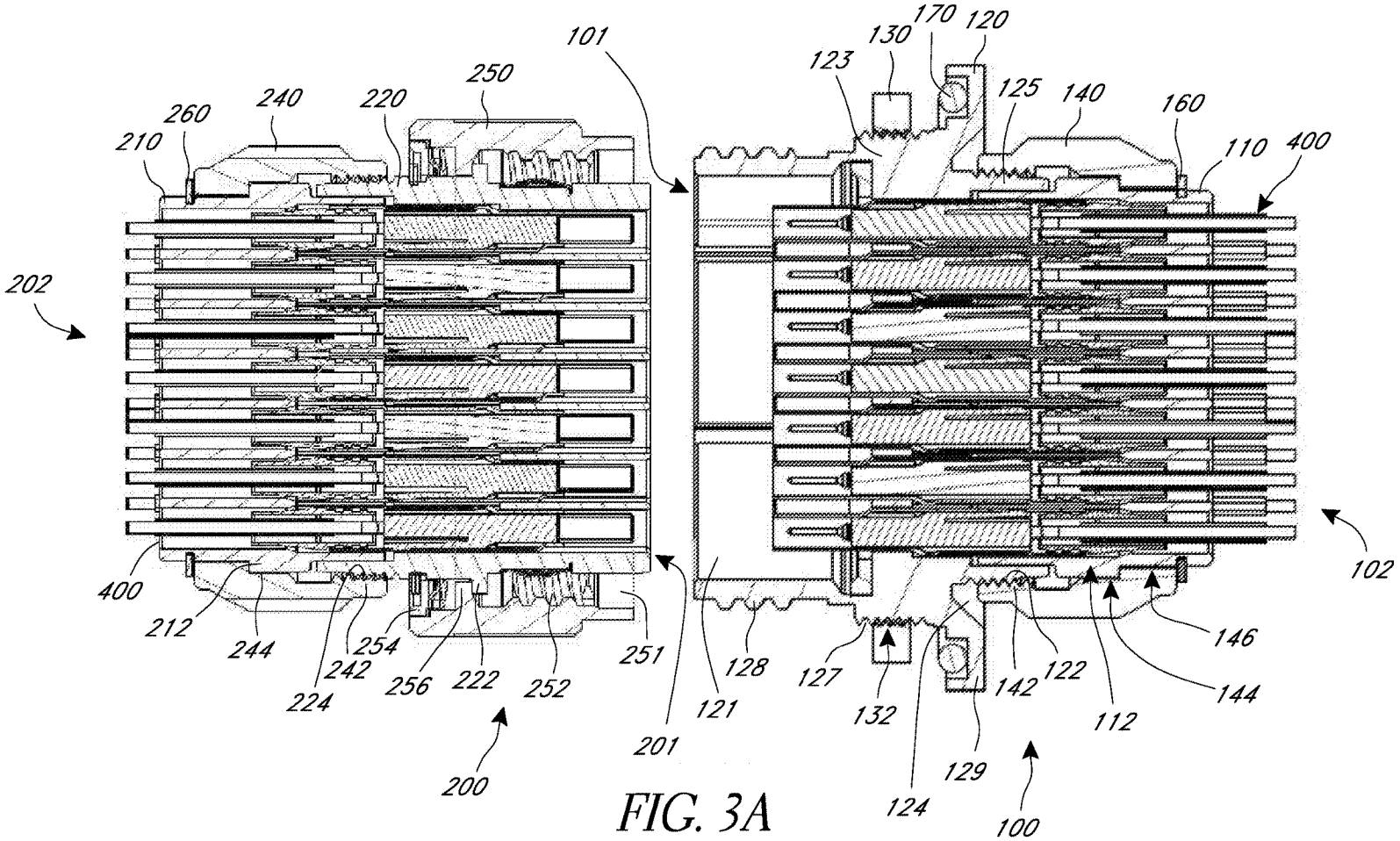
FIG. 3A illustrates a cross-sectional view of the genderless electrical connector along a first axis, with the first and second connector portions in a disengaged state.
Figure 3B:
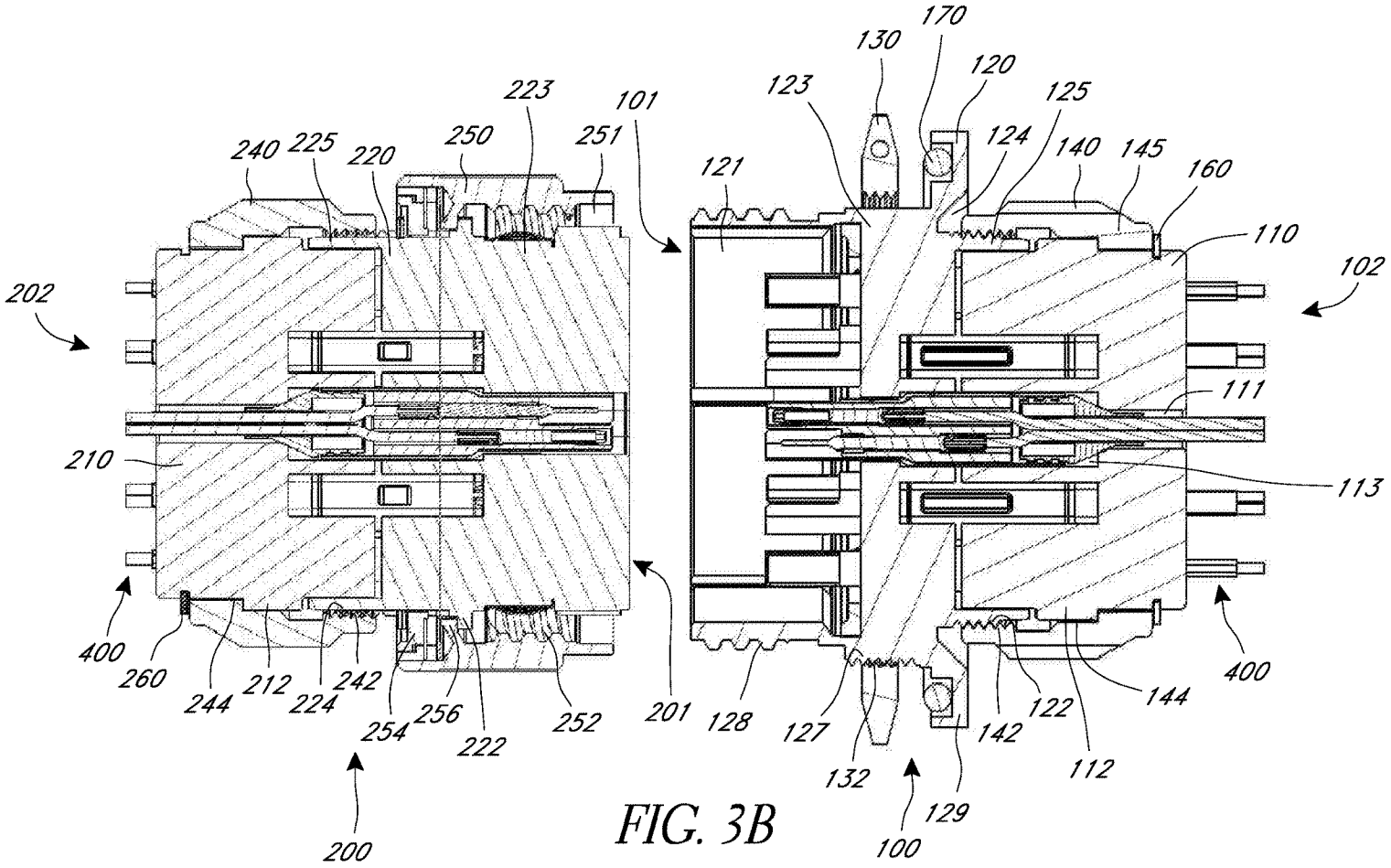
FIG. 3B illustrates a cross-sectional view of the genderless electrical connector along a second axis, with the first and second connector portions in the disengaged state.
Figure 4A:
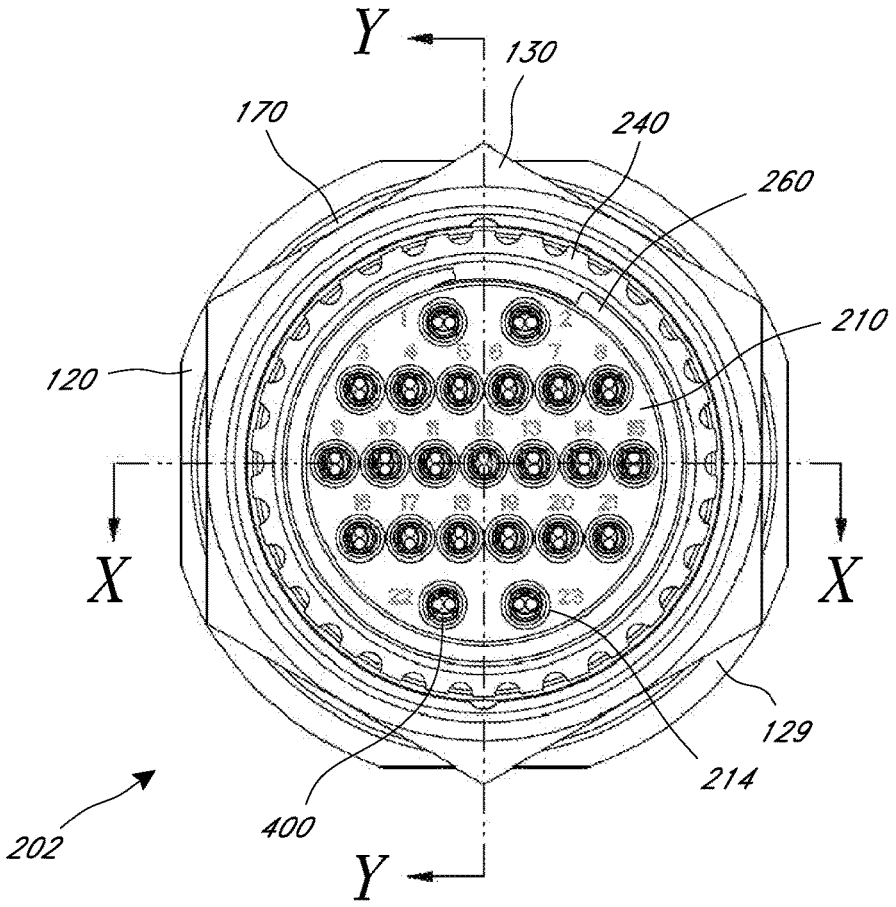
FIG. 4A illustrates a frontal view of the cable end of the first connector portion of FIGS. 1A-1E, which forms a first end of the genderless electrical connector.
Figure 4B:
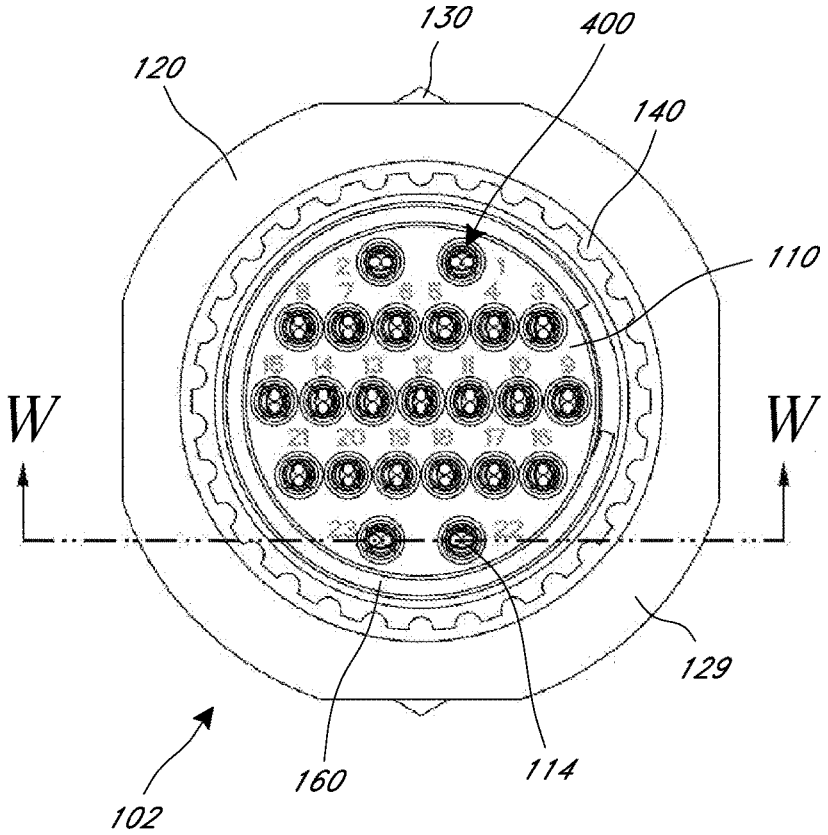
FIG. 4B illustrates a frontal view of the cable end of the second connector portion of FIGS. 2A-2D, which forms a second end of the genderless electrical connector.

As discussed above, FIGS. 1A-1K, 2A-2D, 3A-3B, and 4A-4E illustrate an embodiment of the pair of genderless electrical connectors. FIGS. 1A-1K illustrate a plurality of views of the first connector portion 100 while FIGS. 2A-2D illustrate a plurality of views of the second connector portion 200. FIGS. 3A-3B illustrate cross-sectional views of the first connector portion 100 and the second connector portion 200 along two perpendicular axes to illustrate an example of how the first connector portion 100 and the second connector portion 200 can be lined up and engaged. FIGS. 4A-4B illustrate an embodiment of the genderless electrical connector 300, which can include the connection of the two mating halves of the pair of genderless electrical connectors. Each of these embodiments will be described in turn.

Figure 1A:
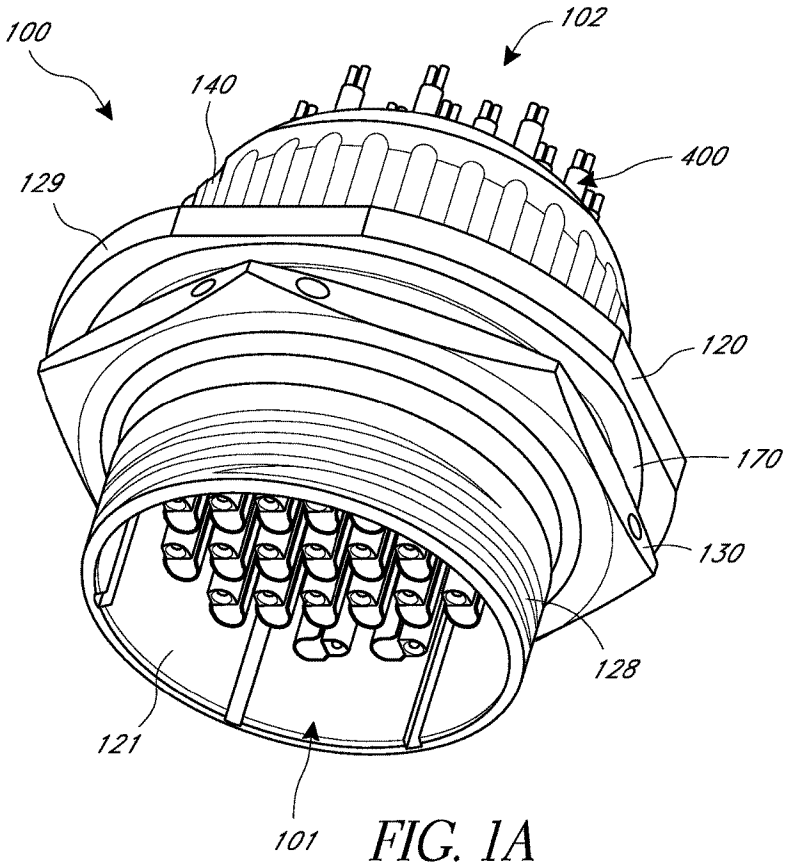
Figure 1C:
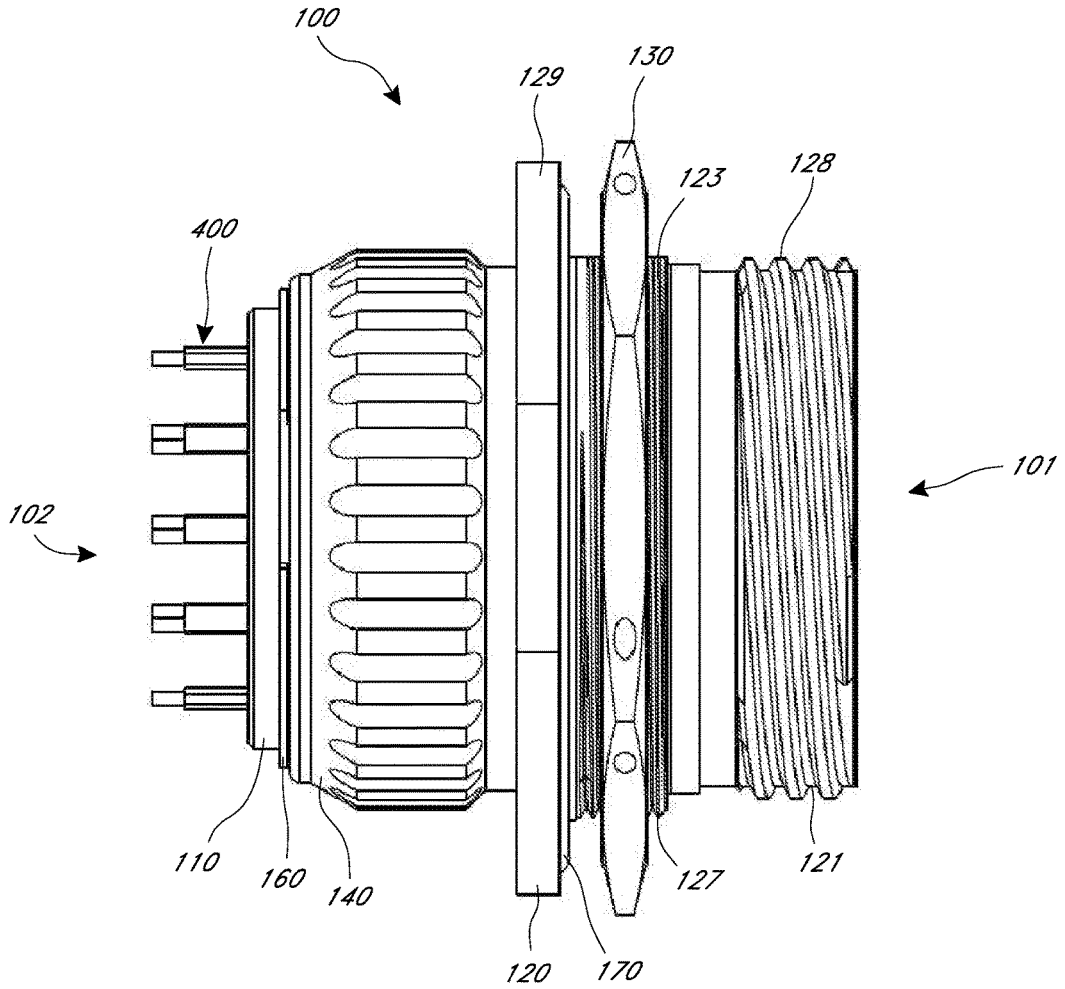
FIG. 1C illustrates a side view of the first connector portion of FIGS. 1A and 1B.
Figures 1D, 1E, 1F:
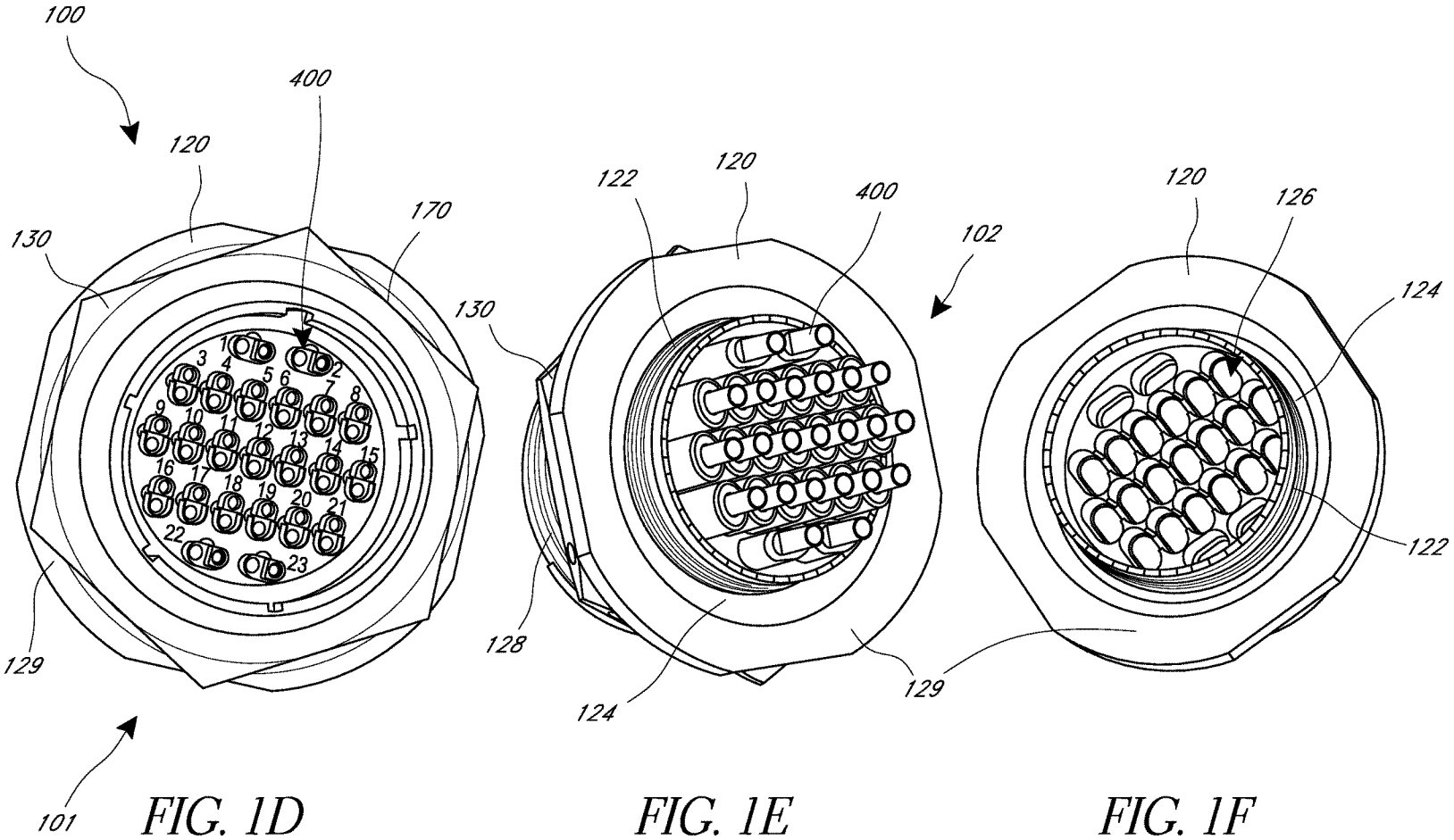
FIGS. 1D-1F illustrate perspective views of the first connector portion of FIGS. 1A and 1B with various components removed to provide a view of the enclosed genderless inserts, and other features.

Turning first to one portion of the pair of electrical connectors, FIGS. 1A-1C illustrate perspective and side views of an embodiment of the first connector portion 100. FIG. 1A illustrates a perspective view of the first connector portion 100 with the engagement end 101 near the front and the cable end 102 in the rear. FIG. 1B illustrates another perspective view of the first connector portion 100 with the cable end 102 in the front and the engagement end 101 in the rear. FIG. 1C illustrates a side-perspective of the first connector portion 100. FIG. 1D illustrates a frontal view of the engagement end 101 of the first connector portion 100. FIG. 1E illustrates a frontal view of the cable end 102 of the first connector portion 100. As will be discussed in more detail below, the first connector portion 100 can be configured to retain a plurality of genderless inserts 400. In some variants, each insert can comprise a plurality of pins, such as two pins. As shown, the engagement end 401 of each of the genderless inserts 400 can protrude from the engagement end 101 of the first connector portion 100 and/or the cable end 402 of each of the genderless inserts 400 can protrude from the cable end 102 of the first connector portion 100.

FIGS. 3A-3B illustrate two cross-sectional views of the first connector portion 100 in context with the second connector portion 200, which will be discussed in more detail below. FIG. 3A illustrates a cross-sectional view of the first connector portion 100 along a first axis that runs through the center of the first connector portion 100 such that it bisects the center row of genderless inserts 400 to illustrate only the female connector 440 portion. FIG. 3B illustrates a cross-sectional view of the first connector portion 100 along a second axis that is perpendicular to the first axis and runs through the center of the first connector portion 100 such that it bisects and illustrates a cross-section of a single genderless insert 400.

In some embodiments, the first connector portion 100 can include a backshell cable support 110 that can be configured to retain the plurality of genderless inserts 400. As illustrated in FIGS. 1B and 1E, the backshell cable support 110 can form the cable end 102 of the first connector portion 100.

In some examples, the backshell cable support 110 can include external features. In some embodiments, the backshell cable support 110 can include an external shelf 112 (FIG. 3B) that extends from a portion of the outer surface of the backshell cable support 110 to form a band about the outer surface of the generally cylindrical backshell cable support 110. As will be discussed in more detail below, the external shelf 112 can engage with and/or help retain a locking nut 140 about the backshell cable support 110 to allow the locking nut 140 to rotate about the surface of the backshell cable support 110.

The backshell cable support 110 can include a groove near the cable end 102 of the backshell cable support 110 that can retain a securement ring 160. In some embodiments, the securement ring 160 can extend entirely or partially about the circumference of the backshell cable support 110. In some embodiments, like the external shelf 112, the securement ring 160 can help to retain the locking nut 140 (described in greater detail below) about the surface of the backshell cable support 110 to allow rotational movement of the locking nut 140 relative to the backshell cable support 110.

Figure 1I:
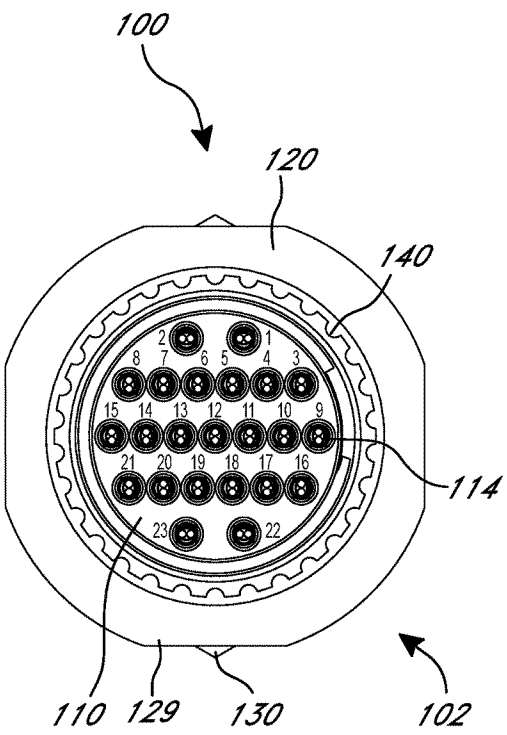
FIG. 1I illustrates another frontal view of the cable end of the first connector portion of FIGS. 1A and 1B.
Figure 1H:
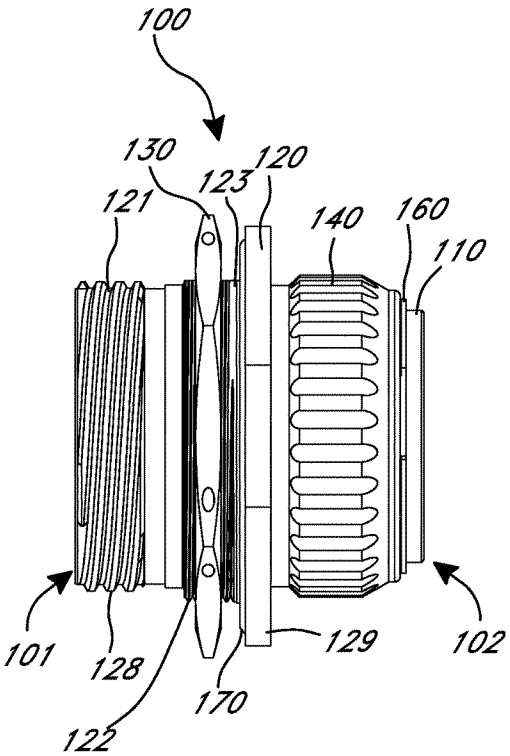
FIG. 1H illustrates another side view of the first connector portion of FIGS. 1A and 1B.
Figure 1G:
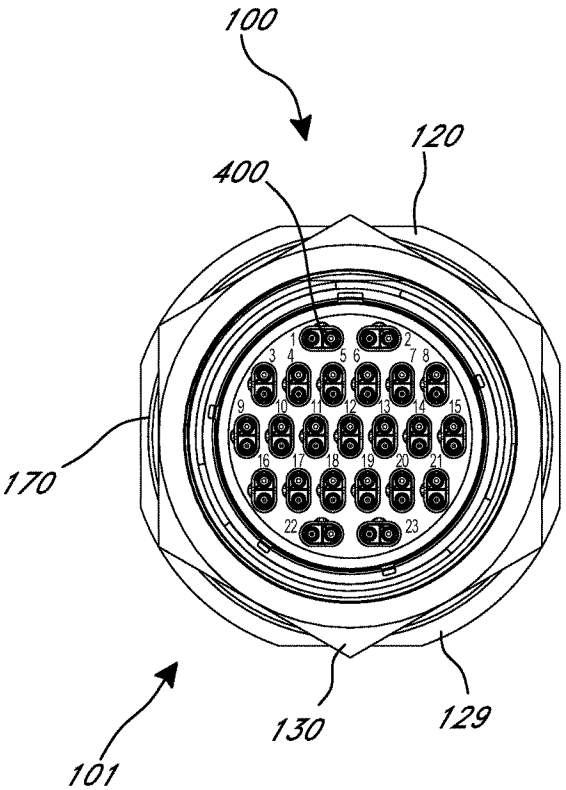
FIG. 1G illustrates another frontal view of the engagement end of the first connector portion of FIGS. 1A and 1B.
Figure 1K:
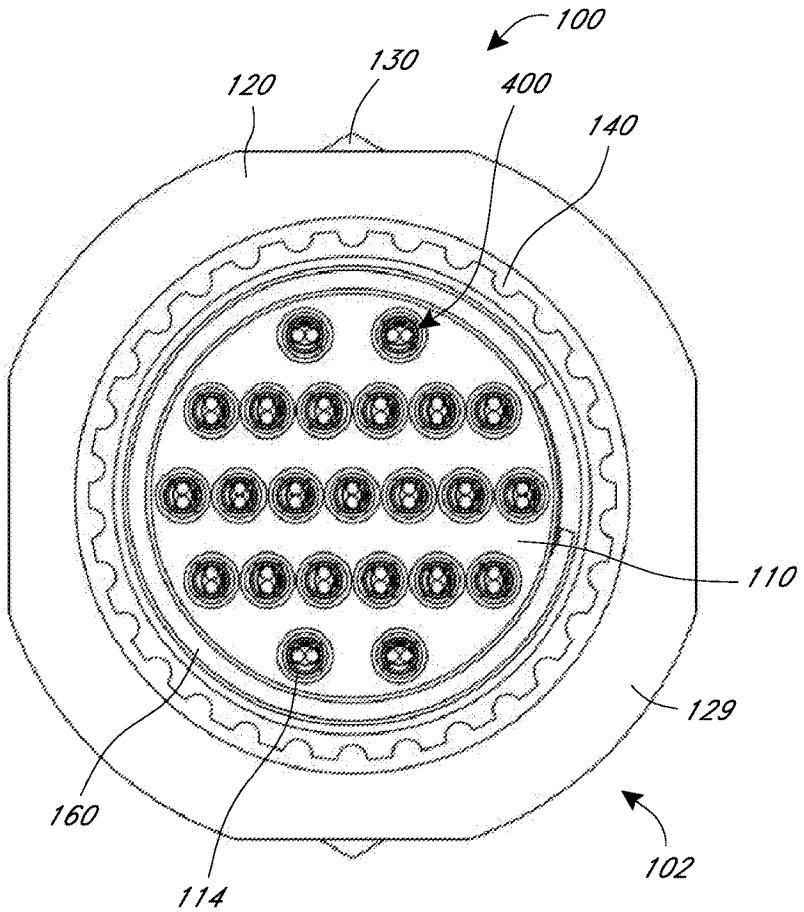
FIG. 1K illustrates a frontal view of the cable end of the first connector portion of FIGS. 1A and 1B.
Figure 1J:
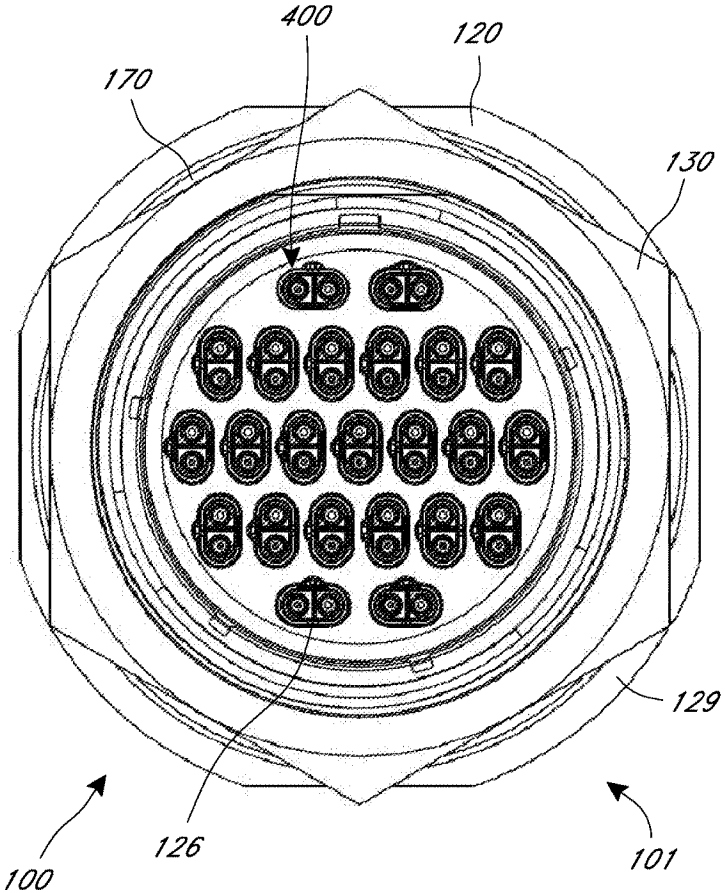
FIG. 1J illustrates a frontal view of the engagement end of the first connector portion of FIGS. 1A and 1B.

In some examples, the backshell cable support 110 can be generally cylindrical. As shown in FIG. 1I, in some embodiments, the backshell cable support 110 has a plurality of openings 114 that extend through the axial length of the backshell cable support 110. As illustrated in FIG. 1I, the openings 114 can receive the genderless inserts 400. The plurality of openings 114 can be arranged in various configurations. For example, in some embodiments, the plurality of openings 114 can be arranged in rows, in a circular pattern, or otherwise. As illustrated in FIG. 1E, the plurality of openings 114 can be arranged in a number of symmetrical rows. For example, in the embodiment shown, the top row has 2 holes, the second row has 6 holes, the third row has 7 holes, the fourth row has 6 holes, and the bottom row has 2 holes.

In some embodiments, some or each of the plurality of openings 114 change in diameter as they extend through the backshell cable support 110. In some examples, the change in diameter allows each of the plurality of openings 114 to retain and accommodate the shape of each of the genderless inserts (e.g., genderless insert 400). For example, as illustrated in FIG. 3B, some or each of the plurality of openings 114 can include a narrowed first section 111 and a wider second section 113. In some embodiments, the first section 111 can accommodate the cable end 402 of the genderless insert 400 while the second section 113 can be configured to accommodate the width of the external shell 420 of the genderless insert 400.

As mentioned above, the first connector portion 100 can include the locking nut 140. In some embodiments, the locking nut 140 can be generally cylindrical and be retained about the surface of the backshell cable support 110. In some embodiments, the locking nut 140 can have grooves formed about the outer surface of the locking nut 140. These grooves can provide a tactile surface that can allow a user to more easily rotate and maneuver the locking nut 140 about the backshell cable support 110.

The locking nut 140 can include structures that help the locking nut 140 engage with or interact with other portions of the backshell cable support 110. In some embodiments, the locking nut 140 can include a shelf 144 (FIG. 3B) along the inner surface of the locking nut 140 that is proximal to the cable end 102 of the first connector portion 100. In some examples, the dimensions of the shelf 144 are configured to engage with the external shelf 112 of the backshell cable support 110. In some embodiments, the lip 146 of the locking nut 140 can be retained between the securement ring 160 and a surface of the external shelf 112. This can allow the locking nut 140 to be rotationally movable about the outer surface of the backshell cable support 110.

In some embodiments, the locking nut 140 can include internal threads 142 along the inner surface of the locking nut 140 that is proximal to the engagement end 101 of the first connector portion 100. As will be discussed in more detail below, the internal threads 142 are configured to engage with external threads of a web shell 120.

As shown in FIG. 3A, the first connector portion 100 can include the web shell 120. In some embodiments, the web shell 120 can be generally cylindrical and include a shell engagement portion 125, a shell body 123, and a shell bottom 121. In some examples, the inner surface of the shell engagement portion 125 can be disposed about a portion of the backshell cable support 110 such that each of the genderless insert 400 are further secured by the web shell 120. In some examples, the web shell 120 can be made of metal, such as aluminum or stainless steel. In some embodiments, the web shell 120 can be a metal injection molded material, composite plated plastics, or any material that is conductive so as to provide continual ground isolation. In some embodiments, the material properties of the web shell 120 can provide continuous ground isolation for each of the genderless inserts 400 retained in the first connector portion 100.

In some embodiments, the web shell 120 can include a plurality of openings 126 that extend through the shell body 123 of the web shell 120. In some examples, as illustrated in FIGS. 1D-1E, the positioning of each of the plurality of openings 126 can be positioned to correspond with the position of each of the plurality of openings 114 in the backshell cable support 110. In some embodiments, the shape and size of each of the plurality of openings 126 can be configured to secure each of the plurality of genderless inserts 400 such that the engagement end 401 of the genderless inserts 400 extends through each of the plurality of openings 126 and into the shell bottom 121 of the web shell 120.

As illustrated in FIGS. 3A-3B, the shell bottom 121 can be configured to engage with the engagement end 201 of the second connector portion 200. In some embodiments, the shell bottom 121 can be a generally cylindrical shell that is concentric with the plurality of genderless inserts 400 that are extended through the first connector portion 100. In some examples, the shell bottom 121 can include an external male engagement portion 128 that can be configured to engage with the engagement end 201 of the second connector portion 200. In some embodiments, the external male engagement portion 128 can be an external thread that is formed on the outer surface of the web shell 120. As will be discussed below, in some examples, the external male engagement portion 128 can be configured to engage with complementary threading on the second connector portion 200 to secure the first connector portion 100 with the second connector portion 200.

In some examples, the web shell 120 can include a shell engagement portion 125 that can be configured to engage with the locking nut 140. In some embodiments, the shell engagement portion 125 can include threads 122 on the external surface of the shell engagement portion 125. In some embodiments, the threads 122 of the shell engagement portion 125 can engage with the internal threads 142 to allow the locking nut 140 to rotate about the shell engagement portion 125.

In some embodiments, the web shell 120 can include a shell body 123 that can be located between the shell engagement portion 125 and the shell bottom 121. The shell body 123 can include a circular ring 129 that is formed about the outer surface of the web shell 120. As illustrated in FIGS. 3A-3B, this circular ring 129 can be located adjacent to the shell engagement portion 125. In some examples, the circular ring 129 can include a groove 124 on a first side of the circular ring 129 adjacent to the shell engagement portion 125. In some embodiments, the groove 124 can be concentric with the web shell 120 and have an angled depth. In some examples, the angled depth can accommodate the end of the locking nut 140 proximal to the engagement end 101 of the first connector portion 100 as the internal threads 142 are rotated about the thread 122 of the shell engagement portion 125 to cause lateral movement in the locking nut 140. In some examples, the web shell 120 can include a second groove located on a second side of the circular ring 129.

As illustrated in FIGS. 3A-3B, this groove can retain a sealing member, such as an o-ring 170. In some embodiments, the o-ring 170 can be made of plastic or rubber.

In some examples, the shell body 123 can include an external thread 127 on the outer surface of the shell body 123. In some embodiments, the external thread 127 can be configured to engage with the internal thread 132 of a securing member, such as a jam nut 130. As illustrated in FIGS. 1A-1E and 3A-3B, the jam nut 130 can have a number of different shapes (e.g., hexagonal) and can be configured to facilitate securing the first and second mating halves 100, 200. In some examples, as the internal thread 132 of the jam nut 130 engages with the external thread 127 of the shell body 123, the jam nut 130 can rotate about the outer surface of the shell body 123 and move laterally along the central axis of the first connector portion 100.

Turning now to the second portion 200 of the pair of electrical connectors. FIGS. 2A-2B illustrate perspective views of an embodiment of the second connector portion 200. FIG. 2A illustrates a perspective view of the second connector portion 200 with the engagement end 201 near the front and the cable end 102 in the rear. FIG. 2B illustrates another perspective view of the second connector portion 200 with the cable end 202 in the front and the engagement end 201 in the rear. FIG. 2C illustrates a frontal view of the engagement end 201 of the second connector portion 200 and FIG. 2D illustrates a frontal view of the cable end 202 of the second connector portion 200. As will be discussed in more detail below, the second connector portion 200 can be configured to retain a plurality of genderless inserts 400, wherein the engagement end 401 of each of the genderless inserts 400 protrude from the engagement end 201 of the second connector portion 200 and the cable end 202 of each of the genderless inserts 400 protrude from the cable end 202 of the second connector portion 200. In some embodiments, the inserts 400 in the second connector portion 200 are similar or identical to the inserts 400 in the first connector portion 100.

FIGS. 3A-3B illustrate two cross-sectional views of the second connector portion 200 in context with the first connector portion 100 (discussed in detail above). As noted above, FIG. 3A illustrates a cross-sectional view of the second connector portion 200 along a first axis that runs through the center of the second connector portion 200 such that it bisects the center row of genderless inserts 400 to illustrate only the male connector 440 portion. FIG. 3B illustrates a cross-sectional view of the second connector portion 200 along a second axis that is perpendicular to the first axis and runs through the center of the second connector portion 200 such that is bisects and illustrates a cross-section of a single genderless insert 400.

In some embodiments, the second connector portion 200 can include a backshell cable support 210 that can be configured to retain the plurality of genderless inserts 400. The backshell cable support 210 can be similar to the backshell cable support 110 disclosed above and can have any of the features of the backshell cable support 110. As illustrated in FIGS. 2B and 2D, the backshell cable support 210 can form the cable end 202 of the second connector portion 200.

In some embodiments, the backshell cable support 210 can include an external shelf 212. In certain variants, the shelf 212 extends from a portion of the outer surface of the backshell cable support 210 and/or forms a band about the outer surface of the generally cylindrical backshell cable support 210. As discussed above with regard to the external shelf 112 of the backshell cable support 110, the external shelf 212 can help to retain a locking nut 240 about the backshell cable support 210 to allow it to rotate about the surface of the backshell cable support 210.

The backshell cable support 210 can include a groove near the cable end 202 of the backshell cable support 210 that can retain a securement ring 260. Similar to the backshell cable support 110 of the first connector portion 100, in some embodiments, the securement ring 260 can extend entirely or partially about the circumference of the backshell cable support 210. In some embodiments, the securement ring 260 can help to retain the locking nut 240 (like the locking nut 140 described above) about the surface of the backshell cable support 210 and/or to allow rotational movement of the locking nut 240 relative to the backshell cable support 210.

In some examples, the backshell cable support 210 can be generally cylindrical with a plurality of openings 214 that extend through the axial length of the backshell cable support 210. In some embodiments, the plurality of openings 214 are configured to receive a plurality of genderless inserts 400. The diameter of each of the plurality of openings 214 can be the same or vary from one opening to another. The plurality of openings 214 can be arranged in various configurations. For examples, in some embodiments, the plurality of openings 214 can be arranged in rows, in a circular pattern, or other arrangements. As illustrated in FIG. 1D, the plurality of openings 214 can be arranged in a number of symmetrical rows—wherein the first row has 2 holes, the second row has 6 holes, the third row has 7 holes, the fourth row has 6 holes, and the bottom row has 2 holes. In some examples, the configuration of the plurality of openings 214 on the backshell cable support 210 is the same as the configuration of the plurality of openings 114 on the backshell cable support 110. In some variants, the configuration of the openings 214 in the support 210 is a mirror image of the configuration of the openings 114 in the backshell cable support 110.

In some embodiments, each of the plurality of openings 214 can change in diameter as it extends through the backshell cable support 210. In some examples, like the plurality of openings 114 of the backshell cable support 110, the change in diameter allows each of the plurality of openings 214 to retain and accommodate the shape of each of the genderless inserts (e.g., genderless insert 400). For example, as illustrated in FIG. 3B, each of the plurality of openings 214 can include a narrowed first section 211 and a wider second section 213. In some embodiments, the first section 211 can accommodate the cable end 402 of the genderless insert 400 while the second section 213 can be configured to accommodate the width of the external shell 420 of the genderless insert 400.

In some examples, the second connector portion 200 can include a locking nut 240. The locking nut 240 of the second connector portion 200 is similar to the locking nut 140 of the first connector portion 100. In some embodiments the locking nut 240 can be generally cylindrical and retained about the surface of the backshell cable support 210. In some embodiments, the locking nut 240 can have grooves formed about the outer surface of the locking nut 240. These grooves can provide a tactile surface that can improve a user's ability to rotate and maneuver the locking nut 240 about the backshell cable support 210.

In some embodiments, the locking nut 240 can include structures that help the locking nut 240 engage with or interact with other portions of the backshell cable support 210. For example, as shown in FIG. 3A, the locking nut 240 can include a shelf 244 along the inner surface of the locking nut 240 that is proximal to the cable end 202 of the second connector portion 200. In some examples, the shelf 244 is configured to engage (e.g., abut) with the external shelf 212 of the backshell cable support 210. In some embodiments, a lip 246 of the locking nut 240 can be retained between a securement ring 260 and a surface of the external shelf 212. The locking nut 240 can be rotationally movable about the outer surface of the backshell cable support 210.

In some embodiments, the locking nut 240 can include internal threads 242 along the inner surface of the locking nut 240 that is proximal to the engagement end 201 of the second connector portion 200. As will be discussed in more detail below, the internal thread 242 can be configured to engage with external threads of a web shell 220. In some examples, the rotational engagement between the internal thread 242 and the web shell 220 can secure the backshell cable support 210 to the web shell 220.

As mentioned above, the second connector portion 200 can include the web shell 220. In some embodiments, the web shell 220 can be generally cylindrical. The web shell 220 can include a shell engagement portion 225 and a shell body 223. In some examples, the inner surface of the shell engagement portion 225 can be disposed about a portion of the backshell cable support 210. This can enable each of the genderless inserts 400 to be further secured by the web shell 220.

In some embodiments, the web shell 220 can include a plurality of openings 226 that extend through the shell body 223 of the web shell 220. In some examples, as illustrated in FIGS. 2C-2D, the positioning of each of the plurality of openings 226 can correspond with the position of each of the plurality of openings 214 in the backshell cable support 210. In some embodiments, the shape and size of each of the plurality of openings 226 can be configured to secure each of the genderless inserts 400. In some embodiments, the engagement end 401 of the genderless inserts 400 extends through each of the plurality of openings 226.

In some embodiments, the shell body 223 can include an external shelf 222 that extends from a portion of the outer surface of the shell body 223. The shelf 222 can form a band about the outer surface of the shell body 223. As will be discussed in more detail below, the external shelf 222 can help to retain a female engagement portion 250 about the shell body 223 of the web shell 220 to allow it to rotate about the surface of the web shell 220. For example, as shown, the shelf 222 can abut with the female engagement portion 250.

The shell 220 can be configured to rotatably connect with the female engagement portion 250. For example, the shell body 223 of the web shell 220 can include a groove near the cable end 202 of the web shell 220 that can retain a retainment portion 254 of the female engagement portion 250. As will be discussed in more detail below, the retainment portion 254 can be configured to retain the female engagement portion 250 about the outer surface of the web shell 220 such that the female engagement portion 250 can be rotated relative to the web shell 220.

In some examples, the web shell 220 can include a shell engagement portion 225 that can be configured to engage with the locking nut 240. In some embodiments, the shell engagement portion 225 can include the external shelf 222 on the external surface of the shell engagement portion 225. In some embodiments, the external shelf 222 of the shell engagement portion 225 can engage with the internal thread 242 to allow the locking nut 240 to rotate about the shell engagement portion 225. In some examples, this rotational movement can secure the backshell cable support 210 with the web shell 220.

As previously mentioned, the second connector portion 200 can include the female engagement portion 250. The female engagement portion 250 can be disposed about the surface of the web shell 220 near the engagement end 201 of the second connector portion 200. As noted above, in some examples, the female engagement portion 250 can be configured to be retained such that it is rotatable relative to the web shell 220. In some embodiments, the female engagement portion 250 is configured to secure the engagement end 201 of the second connector portion 200 to the engagement end 101 of the first connector portion 100.

The female engagement portion 250 can include structures that are configured to engage the female engagement portion 250 with portions of the web shell 220. In some embodiments, the female engagement portion 250 can include a shelf 256 along the inner surface of the female engagement portion 250 that is proximal to the cable end 202 of the second connector portion 200. In some examples, the shelf 256 is configured to rest flush against a surface of the external shelf 222. In some embodiments, the female engagement portion 250 can include a retainment portion 254 at the end of the female engagement portion 250 that is proximal to the cable end 202 of the second connector portion 200. As discussed above, the retainment portion 254 can be configured to engage with a groove in the web shell 220 and allow the female engagement portion 250 to rotate about the outer surface of the web shell 220. In some examples, the external shelf 222 of the web shell 220 and the groove in the external shelf 222 can help to retain the position of the female engagement portion 250 and/or to restrict lateral movement of the female engagement portion 250 along the central axis of the second connector portion 200.

In some embodiments, the female engagement portion 250 can include structures that are configured to engage with the external male engagement portion 128 of the web shell 120. In some examples, the female engagement portion 250 can include an internal thread 252 that is located on the internal surface of the female engagement portion 250. In some embodiments, the internal thread 252 can be configured to engage with the threads on the external surface of the external male engagement portion 128 of the web shell 120. In some embodiments, the internal surface of the female engagement portion 250 is a distance away from the genderless inserts 400 retained within the second connector portion 200 so as to accommodate the external male engagement portion 128 of the web shell 120 on the first connector portion 100.

In some examples, the female engagement portion 250 can be rotated to engage the internal threads 252 of the female engagement portion 250 with the external threads on the exterior surface of the external male engagement portion 128. This rotational movement can cause the first connector portion 100 to move laterally along the central axis of the second connector portion 200 to bring the first connector portion 100 and the second connector portion 200 in proximity to each other. In some examples, this can secure the engagement end 101 of the first connector portion 100 with the engagement end 201 of the second connector portion 200 such that the engagement end 401 of the genderless inserts 400 retained within the first connector portion 100 are engaged with the engagement end 401 of the genderless inserts 400 retained within the second connector portion 200.

FIGS. 4A-4E illustrate an example of the genderless electrical connector 300 that can be formed when the first connector portion 100 and second connector portion 200 are engaged. FIG. 4A illustrates a frontal view of the cable end 202 of the second connector portion 200. FIG. 4B illustrates a frontal view of the cable end 102 of the first connector portion 100.

Figure 4C:
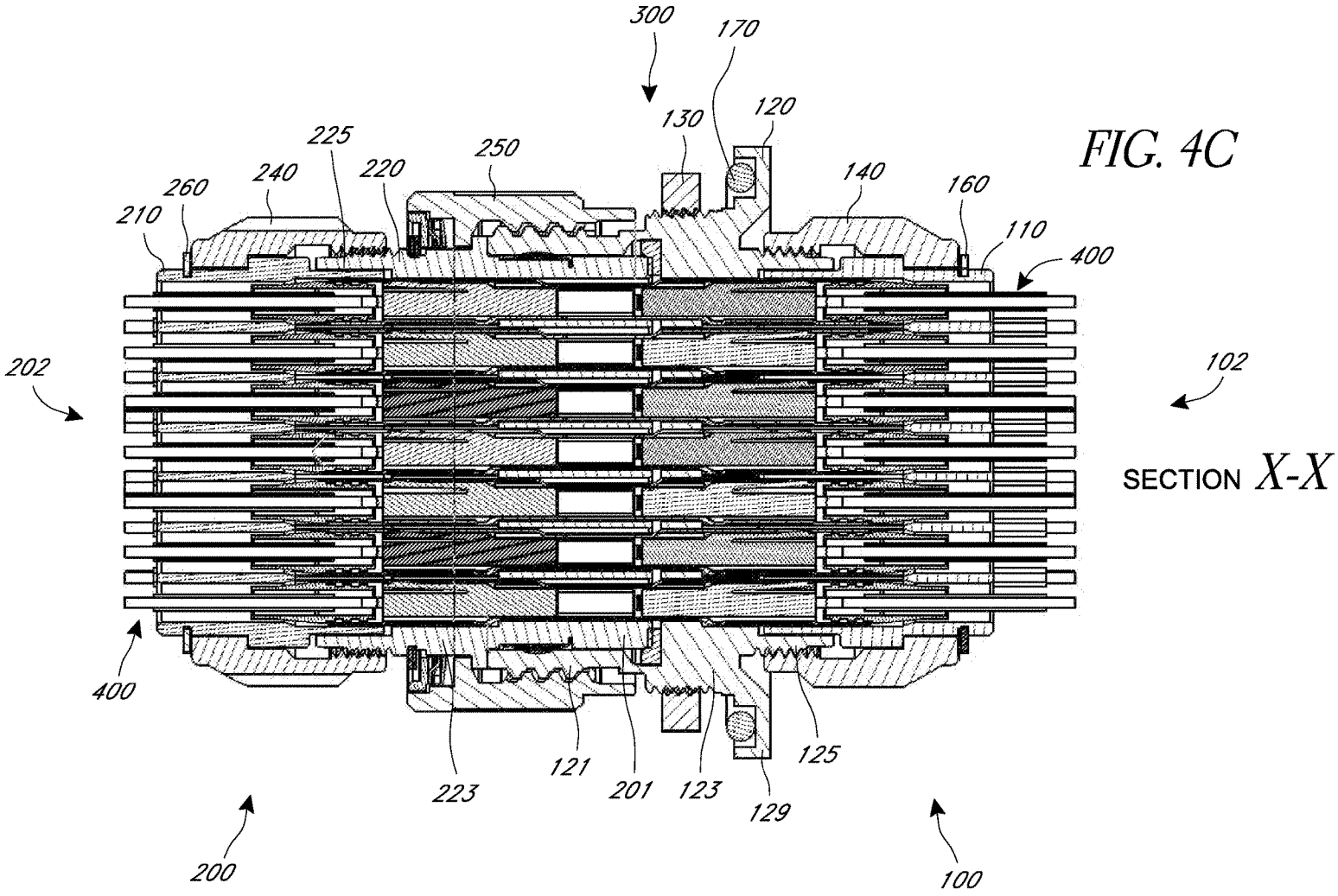
FIG. 4C illustrates a cross-sectional view of the genderless electrical connector along the X-X line, with the first and second connector portions in an engaged state.

FIG. 4C illustrates a cross-sectional view of the genderless electrical connector 300 along the X-X line in FIG. 4A. The X-X line bisects the genderless electrical connector 300 through the center row of genderless inserts 400 retained within the genderless electrical connector 300. FIG. 4C illustrates a single male-female connection between a row of genderless inserts 400 of the first connector portion 100 and the second connector portion 200.

Figure 4D:
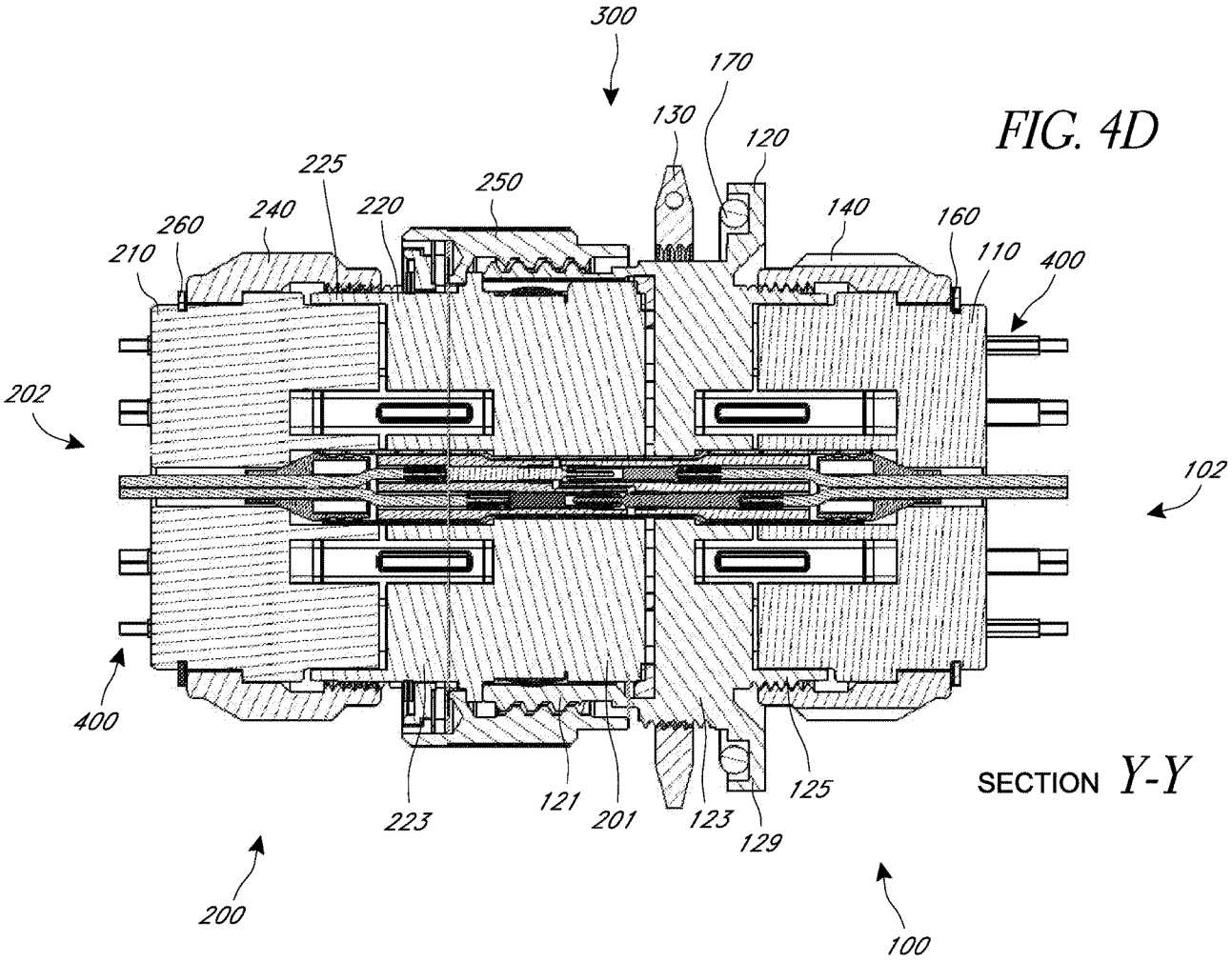
FIG. 4D illustrates a cross-sectional view of the genderless electrical connector along the Y-Y line, with the first and second connector portions in the engaged state.

FIG. 4D illustrates a cross-sectional view of the genderless electrical connector 300 along the Y-Y line in FIG. 4A. The Y-Y line bisects the genderless electrical connector 300 through a single genderless insert 400 retained within the genderless electrical connector 300. FIG. 4D illustrates a cross-section of a single connection between a genderless insert 400 of the first connector portion 100 and the second connector portion 200.

Figure 4E:
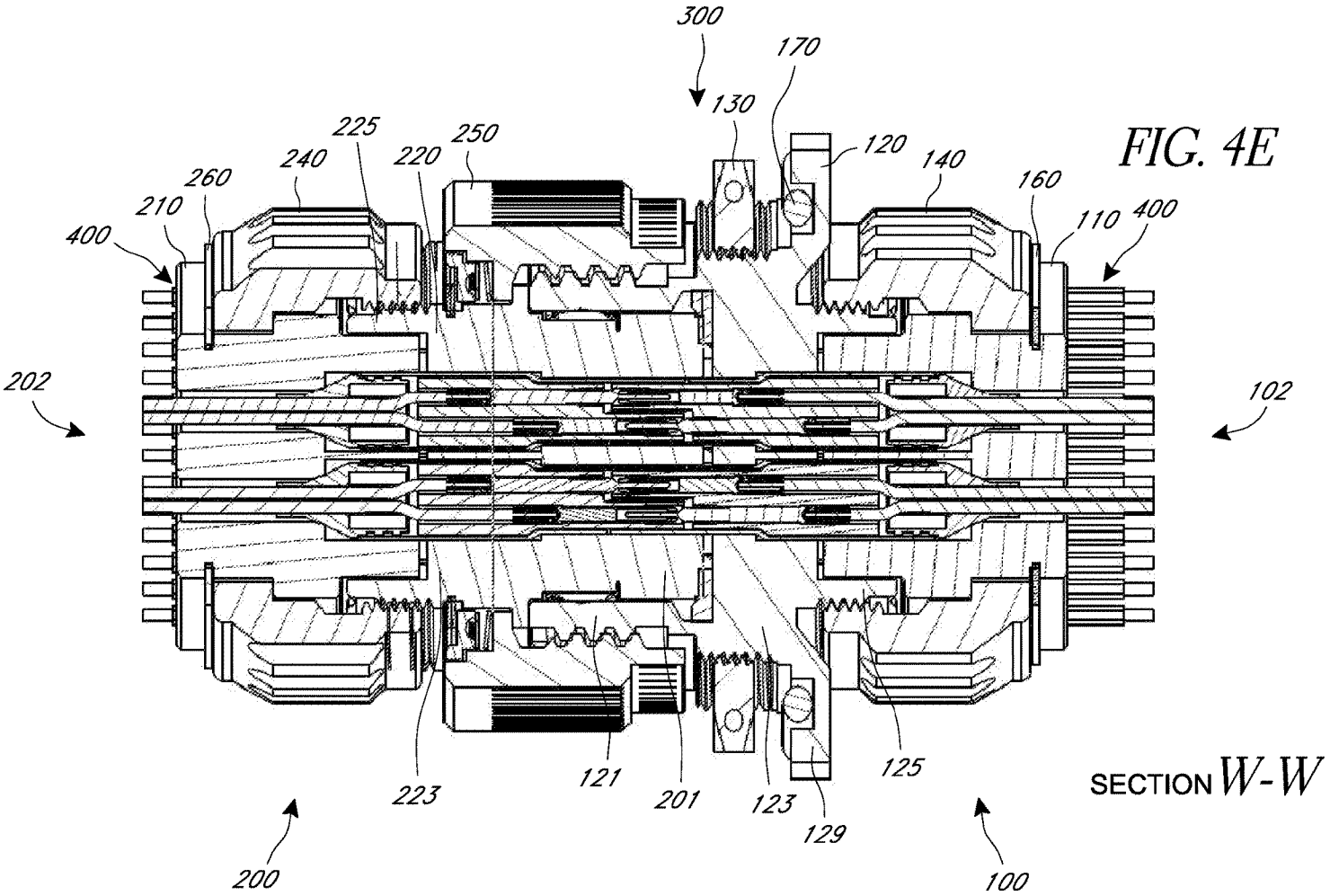
FIG. 4E illustrates a cross-sectional view of the genderless electrical connector along the W-W line, with the first and second connector portions in the engaged state.

FIG. 4E illustrates a cross-sectional view of the genderless electrical connector 300 along the W-W line in FIG. 4B. The W-W line bisects one of the outermost row of genderless inserts 400 that are retained within the genderless electrical connector 300. FIG. 4E provides an illustration of the connection between two genderless inserts 400 of the first connector portion 100 and the second connector portion 200, and provides an angled cross-sectional view of the other components of the first connector portion 100 and the second connector portion 200.

As shown in FIGS. 4C-4E, in some embodiments, when the first connector portion 100 and the second connector portion 200 are engaged, the shell bottom 121 can be disposed about the engagement end 201 of the second connector portion 200. In some examples, as discussed above, the first connector portion 100 can be secured to the second connector portion 200 by engaging the internal thread 252 of the receiving portion 251 with the external male engagement portion 128. In some embodiments, the engagement of the first connector portion 100 and the second connector portion 200 allows the engagement end 401 of the genderless inserts 400 within the first connector portion 100 to be received (e.g., engaged) with the engagement end 401 of the genderless inserts 400 within the second connector portion 200 and vice versa. Details regarding the engagement end 401 of the genderless inserts 400 will be discussed in more detail below.

Certain Embodiments of a Genderless Insert

As noted above, in some embodiments, one aspect of the first connector portion 100 and second connector portion 200 is the decrease in manufacturing costs by increasing the number of cables that can be interconnected by the pair of electrical connectors. As well, manufacturing costs can be decreased by eliminating the use of gendered connectors—connectors that are only male or female and can only receive a male or female counterpart. As will be described in more detail below, in some embodiments, the disclosed genderless inserts 400 can provide a compact and shielded connection that includes both male and female components. In this way, the same design of the genderless inserts 400 can be used in both segments of the electrical connection. In some embodiments, the male and female component can allow each of the genderless inserts 400 to accommodate 2 individual cables.

As shown in FIGS. 5A-5I, each of the genderless inserts 400 can include a plurality of components to retain two individual cables and the associated male and female components. In some examples, each of the genderless inserts 400 can include a casing 410, external shell 420, and retention shell 470.

Figure 5B:
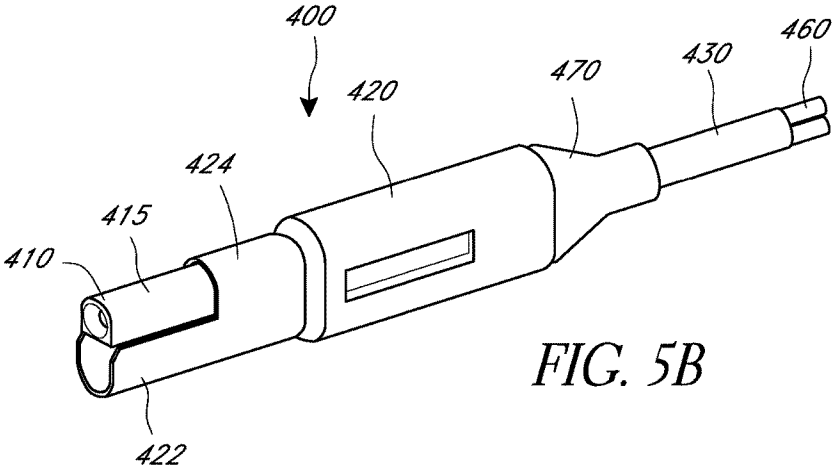
FIGS. 5A-5C illustrate perspective views of an embodiment of a genderless insert.
Figure 5A:
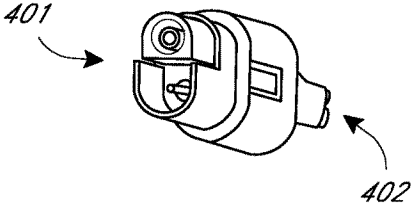
Figure 5C:
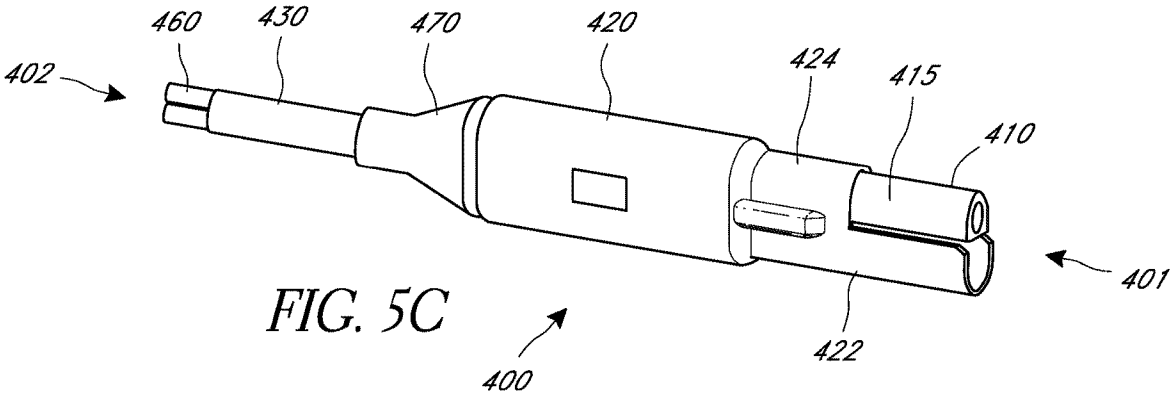
Figure 5E:
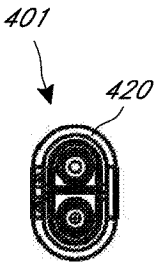
FIG. 5E illustrates a frontal view of the engagement end of the genderless insert of FIGS. 5A-5C.
Figure 5G:
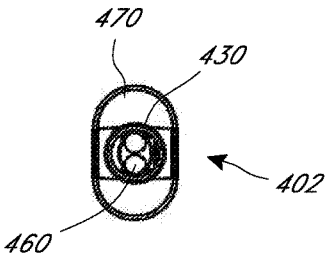
FIG. 5G illustrates a cable end view of the genderless insert of FIGS. 5A-5C.
Figure 5D:
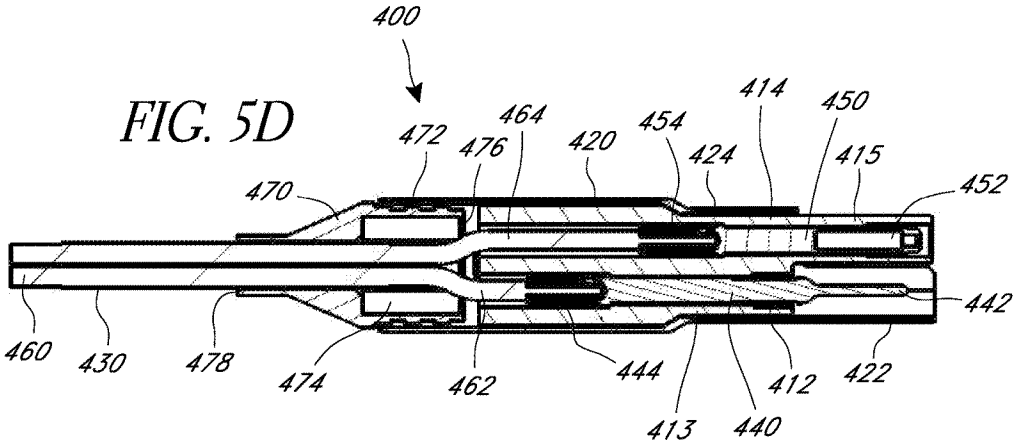
FIG. 5D illustrates a cross-sectional view of the genderless insert of FIGS. 5A-5C.
Figure 5F:
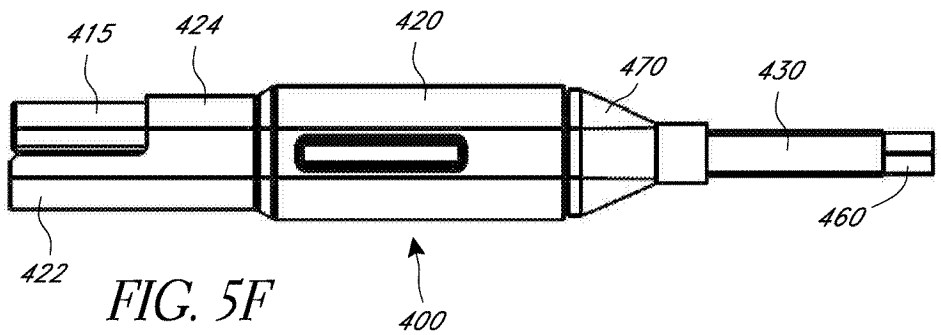
FIG. 5F illustrates a side view of the genderless insert of FIGS. 5A-5C.

In some examples, the genderless inserts 400 can include an external shell 420. In some embodiments, an engagement end 401 of the genderless inserts 400 can include a first portion 422 and a second portion 424. As illustrated in FIGS. 5D and 5F, the first portion 422 can have a longer length than the second portion 424.

Figure 5H:
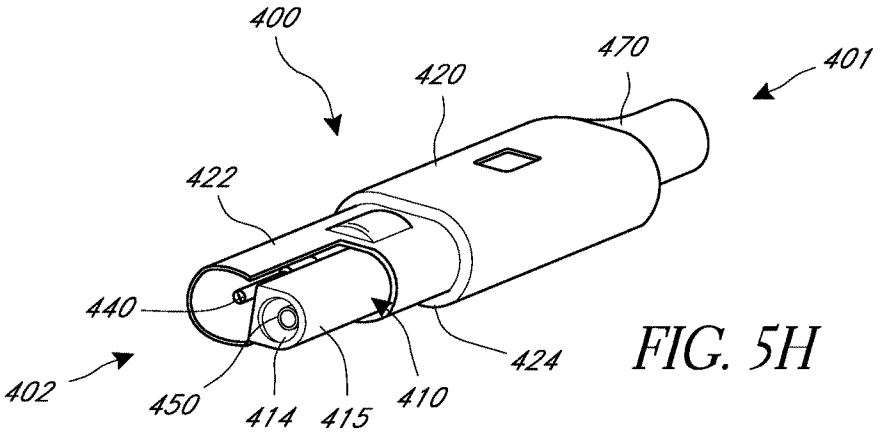
FIG. 5H illustrates a perspective view of the genderless insert of FIGS. 5A-5C.
Figure 5I:
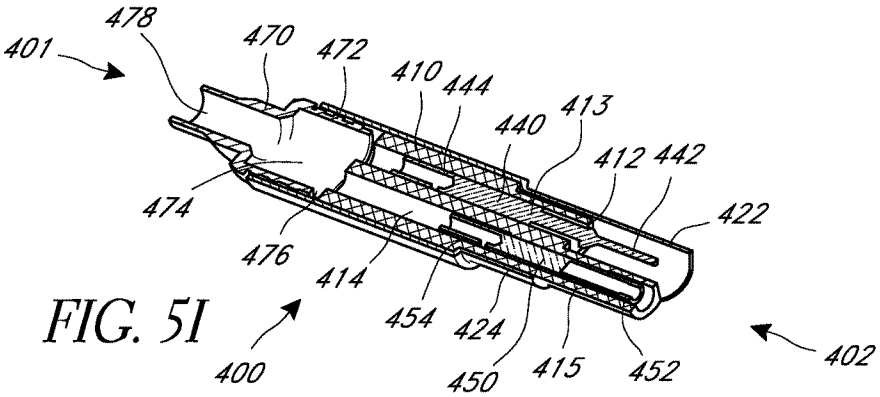
FIG. 5I illustrates a perspective cross-sectional view of the genderless insert of FIGS. 5A-5C.

In some embodiments, the external shell 420 of the genderless inserts 400 can retain and be disposed about the casing 410. As illustrated in FIGS. 5D and 5I, the casing 410 can include a first portion 413 and a second portion 415. In some embodiments, the second portion 415 can have a longer length than the first portion 413. The casing 410 can be configured to protect the retained cables and/or to reduce noise and electric flux. In some embodiments, the casing 410 can provide contact alignment and/or contact retention of the genderless inserts 400 within the male and female components.

In some examples, the casing 410 can be retained in the engagement end 401 of the genderless inserts 400. As illustrated in FIGS. 5F and 5H, in some examples, the casing 410 can be positioned within the external shell 420. In some embodiments, the second portion 415 of the casing 410 can protrude from the second portion 424 of the external shell 420 such that the engagement end 401 of the second portion 415 is aligned with the engagement end 401 of the first portion 422. In some examples, the end of the first portion 413 of the casing 410 can be aligned with the end of the second portion 424. As will be discussed in more detail below, the configuration of the external shell 420 and the casing 410 can allow two genderless inserts 400 to engage with each other.

In some embodiments, the genderless inserts 400 can include a plurality of channels to retain a plurality of cables. As illustrated, the inserts 400 can include a male connector 440 and female connector 450. As shown in FIGS. 5D and 5I, the casing 410 can include a first opening 412 in the first portion 413 of the casing 410. The casing 410 can include a second opening 414 in the second portion 415. In some embodiments, the first opening 412 and the second opening 414 are parallel with each other. In some embodiments, the first opening 412 and the second opening 414 have about the same diameter. In certain implementations, the openings 412, 414 can accommodate the pair of cables 460 (e.g., a first cable 462 and a second cable 464).

The casing 410 can be configured to retain the male and female connectors 440, 450 at the engagement end 401 of the genderless inserts 400. In some embodiments, the casing 410 can retain the male connector 440 in the first opening 412 of the first portion 413 near the engagement end 401 of the genderless inserts 400. In some examples, the male connector 440 can have a first end 442 and a second end 444. The first end 442 of the male connector 440 can be configured to be inserted into a portion of the female connector 450 of another instance of the genderless inserts 400. The second end 444 of the male connector 440 can be configured to attach to and form a connection with a portion of the first cable 462.

In some embodiments, the first end 442 of the male connector 440 can be an elongate pin. As will be discussed in more detail below, in some embodiments, the male connector 440 can be configured to be inserted into a portion of the female connector 450. In some examples, the second end 444 of the male connector 440 can include a recess that is configured to receive a portion of the first coaxial cable 462. In some embodiments, the diameter of the first end 442 and the second end 444 of the male connector 440 are the same or less than the diameter of the male connector 440.

In some embodiments, the casing 410 can retain the female connector 450 in the second opening 414 of the second portion 415 near the engagement end 401 of the genderless inserts 400. In some examples, the female connector 450 can have a first end 452 and a second end 454. The first end 452 of the female connector 450 can be configured to receive the first end 442 of the male connector 440 of another instance of the genderless inserts 400. The second end 454 of the female connector 450 can be configured to attach to and form a connection with a portion of the second cable 464.

In some embodiments, the first end 452 of the female connector 450 can include a channel that is configured to receive the elongate pin of the first end 442 of the male connector 440. In some examples, the second end 454 of the female connector 450 can include a recess that is configured to receive a portion of the second coaxial cable 464. In some embodiments, the diameter of the first end 452 and the second end 454 of the female connector 450 are the same or less than the diameter of the female connector 450.

In some examples, the genderless inserts 400 can include a retention shell 470. In some embodiments, the retention shell 470 can be positioned near the cable end 402 of the external shell 420. In some embodiments, the retention shell 470 can be configured to retain and secure the pair of cables 460 within the genderless inserts 400. In some embodiments, a first end 476 of the retention shell 470 can be configured to engage with the shell 420 to allow the retention shell 470 to be retained within the external shell 420. In some examples, the first end 476 of the retention shell 470 can include a plurality of external teeth 472 disposed about the outer surface of the retention shell 470. The external teeth 472 can help to secure the retention shell 470 within the external shell 420. In some examples, the retention shell 470 can include a narrowed diameter near the second end 478 to aid in securing the pair of cables 460.

As illustrated in FIGS. 5D and 5I, the retention shell 470 can include a shell opening 474 that forms a passageway through the retention shell 470. The cables 460 can extend through the passageway. In some examples, the first cable 462 and the second end 454 are connected near the first end 476 of the retention shell 470. For example, as discussed above, the cables 462, 464 can be retained by the second ends 444, 454 of the connectors 440, 450. The pair of cables 460 can be secured through the body of the retention shell 470 such that the pair of cables 460 extend out of the second end 478 of the retention shell 470. In some embodiments, a dielectric insulator 430 can be disposed about the surface of the pair of cables 460 and/or near the second end 478 of the retention shell 470.

The genderless inserts 400 can be configured such that each genderless insert 400 can mate with another genderless insert 400. For example, a first insert 400 can be configured to mate with a second insert 400 by engaging the male and female component of the first genderless insert 400 with the corresponding female and male component of a second genderless insert 400. In some embodiments, in order for a first insert 400 to mate with a second insert 400, one of the two genderless inserts 400 can be rotated (e.g., at least about 180 degrees), such that the male component of the first insert 400 can engage with the female component of the second insert 400 and vice versa. In some embodiments, one of the two genderless inserts 400 is flipped such that the male component of the first insert 400 can engage with the female component of the second insert 400 and vice versa.

In some embodiments, the first portion 422 of the external shell 420 serves to form a passageway in which to receive the second portion 415 of the casing 410. As illustrated in FIG. 5D, in some embodiments, the elongated portion of the first end 442 of the male connector 440 can extend through the center of the passageway formed by the first end 442. In some examples, the passageway formed by the first portion 422 can accommodate the second portion 415 that is disposed about the female connector 450.

As noted above, the first insert 400 and the second insert 400 can be engaged by rotating the second insert 400 (e.g., 180 degrees). In some embodiments, once rotated, the second portion 415 of the first insert 400 can be inserted into the passageway formed by the first end 442 of the second insert 400 and vice versa. In some examples, this can allow the channel located at the first end 452 of the female connector 450 of the first insert 400 to engage with the elongated portion of the first end 442 of the male connector 440 of the second insert 400 (and vice versa). In this way, a compact electrical connection can be formed between a pair of cables 460

In some embodiments, the genderless inserts 400 can have nested male and female components. For example, the recess of the first end 452 of the female connector 450 can be configured to be disposed about the elongated portion of the first end 442 of the male connector 440. As another example, the passageway formed by the first portion 422 (that is disposed about the male connector 440) can be configured to accommodate the second portion 415 (that is disposed about the female connector 450).

CERTAIN TERMINOLOGY

Terms of orientation used herein, such as "top," "bottom," "horizontal," "vertical," "longitudinal," "lateral," and "end"

are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

Unless otherwise explicitly stated, articles such as "a" or "an" should generally be interpreted to include one or more described items. Accordingly, phrases such as "a device configured to" are intended to include one or more recited devices. Such one or more recited devices can be collectively configured to carry out the stated recitations. For example, "a processor configured to carry out recitations A, B, and C" can include a first processor configured to carry out recitation A working in conjunction with a second processor configured to carry out recitations B and C.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

SUMMARY

Although genderless electrical connectors have been disclosed in the context of certain embodiments and examples (e.g., high density electrical connectors), this disclosure extends beyond the specifically disclosed embodiments to other alternative embodiments and/or uses of the embodiments and certain modifications and equivalents thereof. For example, any of the genderless electrical connectors can be used on other types of connectors or even in other applications, such as a mechanical fastener or securement. Various features and aspects of the disclosed embodiments can be combined with or substituted for one another in order to form varying modes of the genderless electrical connectors. The scope of this disclosure should not be limited by the particular disclosed embodiments described herein.

Certain features that are described in this disclosure in the context of separate implementations can be implemented in combination in a single implementation. Conversely, various features that are described in the context of a single implementation can be implemented in multiple implementations separately or in any suitable subcombination. Although features may be described above as acting in certain combinations, one or more features from a claimed combination can, in some cases, be excised from the combination, and the combination may be claimed as any subcombination or variation of any subcombination.

Moreover, while operations may be depicted in the drawings or described in the specification in a particular order, such operations need not be performed in the particular order shown or in sequential order, and all operations need not be performed, to achieve the desirable results. Other operations that are not depicted or described can be incorporated in the example methods and processes. For example, one or more additional operations can be performed before, after, simultaneously, or between any of the described operations. Further, the operations may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Some embodiments have been described in connection with the accompanying figures. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

In summary, various embodiments and examples of genderless electrical connectors have been disclosed. Although the assemblies have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Thus, the scope of this disclosure should not be limited by the particular disclosed embodiments described above, but should be determined only by a fair reading of the claims that follow.

The following is claimed:

1. An electrical connector comprising:

a first plurality of inserts each comprising a genderless connector comprising a male and female component and being configured to retain a portion of a first cable; and a second plurality of inserts each comprising a genderless connector comprising a male and female component and being configured to retain a portion of a second cable;

a first portion comprising:

a first cable support, the first cable support comprising a plurality of openings configured to retain a first end of the first plurality of inserts; and a first web shell, the first web shell comprising a plurality of openings configured to retain a second end of the first plurality of inserts;

a second portion configured to engage with the first connector, the second portion comprising:

a second cable support, wherein the second cable support comprises a plurality of openings configured to retain a first end of the second plurality of inserts; and a second web shell, the second web shell comprising a plurality of openings configured to retain a second end of the second plurality of inserts.

2. The electrical connector of claim 1, wherein the first plurality of inserts are identical to the second plurality of inserts.

3. The electrical connector of claim 1, wherein the first web shell and second web shell are configured to provide continuous ground isolation for each of the plurality of inserts.

4. The electrical connector of claim 3, wherein the shielding is configured to surround the engagement of the first and second portions.

5. The electrical connector of claim 3, wherein the shielding is configured to protect each of the plurality of inserts from electric flux.

6. The electrical connector of claim 1, wherein the first cable support and the second cable support are cylindrical.

7. The electrical connector of claim 1, wherein the engagement portion is disposed about a portion of the second cable support and includes threading along a portion of the interior surface of the engagement portion.

8. The electrical connector of claim 7, wherein the first cable support including threading along a portion of the exterior surface of the engagement portion.

9. The electrical connector of claim 8, wherein the engagement portion of the second cable support is configured to secure the first cable support, and wherein the interior threading of the engagement portion is configured to engage the exterior threading of the first portion.

10. The electrical connector of claim 2, wherein the first end of each of the plurality of inserts forms an engagement end, the engagement end of each of the plurality of inserts is configured to interact with the engagement end of another of the plurality of inserts.

11. The electrical connector of claim 10, wherein the engagement end further includes:

an external shell portion including a male shell portion and a female shell portion, wherein the male shell portion is longer in longitudinal length than the female shell portion; and a shielding portion including a male shielding portion and a female shielding portion, wherein the male shielding portion is shorter in longitudinal length than the female shielding portion, and wherein the external shell portion is disposed about the shielding portion such that the male shell portion is disposed about the male shielding portion and the female shell portion is disposed about the female shielding portion.

12. The electrical connector of claim 11, wherein the engagement end further includes a male component comprising a longitudinally extending pin and a female component comprising a receiving channel configured to receive the longitudinal extending pin of another of the plurality of inserts.

13. A genderless connector including a male and female component, the connector extending along a longitudinal axis and comprising:

an external shell having an engagement end and a cable end, wherein the external shell includes a male shell portion and a female shell portion, and wherein the male shell portion is longer in longitudinal length than the female shell portion;

a shielding portion having an engagement end and a cable end, wherein the shielding portion includes a male shielding portion and a female shielding portion, wherein the male shielding portion is shorter in longitudinal length than the female shielding portion, and wherein the external shell is disposed about the shielding portion such that the male shell portion is disposed about the male shielding portion and the female shell portion is disposed about the female shielding portion;

a male component having an engagement end and a cable end, wherein at least the cable end of the male component is retained within the male shielding portion, the engagement end comprising a longitudinally extending pin; and a female component having an engagement end and a cable end, wherein at least the cable end of the female component is retained within the female shielding portion, the engagement end comprising a receiving channel configured to receive the pin of another of the genderless connector.

14. The genderless connector of claim 13 configured to retain a first cable and a second cable, wherein the cable end of the male component is configured to engage a portion of the first cable, and wherein the cable end of the female component is configured to engage a portion of the second cable.

15. The genderless connector of claim 13, wherein the male shell portion has about the same longitudinal length as the female shielding portion.

16. The genderless connector of claim 15, wherein the engagement end of the male component extends from the male shielding portion, and wherein the male shell portion forms a lumen about the male component.

17. The genderless connector of claim 16, wherein the lumen is sized to retain the female shielding portion of another genderless connector.

18. The genderless connector of claim 15, wherein the male shell portion has about the same length as the female shielding portion, and wherein the female shell portion has about the same length as the male shielding portion.

19. The genderless connector of claim 13 further including a retention shell retained within the cable end of the external shell, wherein the retention shell is configured to secure at least one cable within the genderless connector.

20. The genderless connector of claim 19, wherein the retention shell is retained within the cable end of the external shell using a plurality of external teeth located on the exterior surface of the retention shell.

21. The genderless connector of claim 13, wherein the shielding portion is configured to provide shielding for the at least one cable retained within the genderless connector.

22. The genderless connector of claim 21, wherein the shielding portion reduces noise.

23. The genderless connector of claim 21, wherein the shielding protects the at least one cable from electric flux.

* * * * *